US009823624B2

(12) United States Patent
Tsuchiya et al.

(10) Patent No.: US 9,823,624 B2
(45) Date of Patent: Nov. 21, 2017

(54) METHOD FOR PRODUCING TIMEPIECE SPRING, DEVICE FOR PRODUCING TIMEPIECE SPRING, TIMEPIECE SPRING, AND TIMEPIECE

(71) Applicant: SEIKO EPSON CORPORATION, Tokyo (JP)

(72) Inventors: Kazuhiro Tsuchiya, Nagano (JP); Masao Takeuchi, Nagano (JP); Masatoshi Moteki, Nagano (JP); Shoichi Nagao, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 860 days.

(21) Appl. No.: 14/017,681

(22) Filed: Sep. 4, 2013

(65) Prior Publication Data

US 2014/0064043 A1 Mar. 6, 2014

(30) Foreign Application Priority Data

Sep. 5, 2012 (JP) ..... 2012-194839
Sep. 5, 2012 (JP) ..... 2012-194840

(51) Int. Cl.
*G04B 1/00* (2006.01)
*G04D 3/00* (2006.01)
(Continued)

(52) U.S. Cl.
CPC ..... *G04D 3/0076* (2013.01); *G04B 1/10* (2013.01); *G04B 1/145* (2013.01); *Y10T 29/49579* (2015.01); *Y10T 29/53* (2015.01)

(58) Field of Classification Search
CPC ..... Y01T 29/49579; G04B 1/145
(Continued)

(56) References Cited

U.S. PATENT DOCUMENTS 3,645,123 A * 2/1972 Auge ..... B21C 37/045 29/896.3
3,928,085 A * 12/1975 Yamamura ..... C22C 19/07 148/419
(Continued)

FOREIGN PATENT DOCUMENTS

CH 181861 A * 1/1936 ..... G04B 1/14
CN 1237250 A 12/1999
(Continued)

OTHER PUBLICATIONS

Hagiwara, M., A. Inoue, and T. Masumoto. "Mechanical Properties of Fe—Si—B Amorphous Wires Produced by In-rotating-water Spinning Method." MTA Metallurgical Transactions A 13.3 (1982): 373-82. SpringerLink. Web. May 26, 2016.*
(Continued)

*Primary Examiner* — Colleen P Dunn
*Assistant Examiner* — Jeremy Jones
(74) *Attorney, Agent, or Firm* — Global IP Counselors, LLP

(57) ABSTRACT

A method for producing a timepiece spring includes a step for producing, by casting, a metallic glass raw material constituted of a metallic glass; a step for heating the metallic glass raw material to achieve a superplastic state; and a step for rolling the metallic glass raw material in a superplastic state to produce a sheet material. A timepiece spring is characterized by being obtained by the method for producing a timepiece spring.

7 Claims, 21 Drawing Sheets

(51) Int. Cl.
*G04B 1/10* (2006.01)
*G04B 1/14* (2006.01)

(58) Field of Classification Search
USPC ..... 29/896.3; 368/140
See application file for complete search history.

(56) References Cited

U.S. PATENT DOCUMENTS

| | | | | |
|---|---|---|---|---|
| 6,843,594 | B1 | 1/2005 | Moteki et al. | |
| 2001/0030908 | A1 | 10/2001 | Moteki et al. | |
| 2009/0303842 | A1* | 12/2009 | Gritti | G04B 1/145 368/140 |
| 2012/0281510 | A1 | 11/2012 | Gyger et al. | |

FOREIGN PATENT DOCUMENTS

| | | | | |
|---|---|---|---|---|
| CN | 2645815 | Y | | 10/2004 |
| JP | 2000102845 | A | * | 4/2000 |
| JP | 3498315 | B2 | | 2/2004 |
| JP | 2005-088075 | A | | 4/2005 |
| JP | 3982290 | B2 | | 9/2007 |
| JP | 2011-067857 | A | | 4/2011 |
| WO | 2011/069273 | A1 | | 6/2011 |

OTHER PUBLICATIONS

Timothy, R.. (2004). Radio-Frequency and Microwave Radiation (3rd Edition)—2.3.2 Induction Furnaces and Heaters. American Industrial Hygiene Association (AIHA).*

* cited by examiner

METHOD FOR PRODUCING TIMEPIECE SPRING, DEVICE FOR PRODUCING TIMEPIECE SPRING, TIMEPIECE SPRING, AND TIMEPIECE

CROSS-REFERENCE TO RELATED APPLICATIONS

This application claims priority to Japanese Patent Application No. 2012-194839 filed on Sep. 5, 2012 and Japanese Patent Application No. 2012-194840 filed on Sep. 5, 2012. The entire disclosure of Japanese Patent Application Nos. 2012-194839 and 2012-194840 is hereby incorporated herein by reference.

BACKGROUND

Technical Field

The present invention relates to a method for producing a timepiece spring, a device for producing a timepiece spring, a timepiece spring, and a timepiece.

Background Technology

Timepiece springs are used for a main spring constituting a power source of a drive mechanism for a timepiece or the like, a balance spring for urging a balance constituting a speed governor, a spring for fixing a crystal oscillator of a crystal oscillator timepiece, and the like. Carbon steel, stainless steel, cobalt alloy, copper alloy, and the like have been employed as a spring material for the uses mentioned above. Amorphous metals, however, have been studied as spring materials in order to achieve a higher precision and more stable operation in precision instruments such as timepieces (see Patent Documents 1 and 2).

A timepiece spring made of the aforementioned amorphous metal can be produced by a method of casting such as single-roll liquid quenching.

Japanese Patent No. 3498315 (Patent Document 1) and Japanese Patent No. 3982290 (Patent Document 2) are examples of the related art.

SUMMARY

Problems to be Solved by the Invention

In the aforementioned method of production, it is difficult to control the amount of molten stock material supplied with high accuracy, and in some instances the sheet material thus produced has an increased width. In a case where a sheet material having a greater width dimension than the desired dimensions is formed, the sheet material needs to be machined with a slitter or the like so as to reach the desired width dimension. Amorphous metals, however, have high strength, and with a Vickers hardness of about HV 800, are hard enough that machining is very difficult at room temperature. For this reason, a problem emerges in that it is very difficult to machine a sheet material made of amorphous metal. Moreover, when produced by a casting technique as described above, a timepiece spring made of amorphous metal in some instances solidifies in a state where air still remains in the surface or interior, and thus is prone to suffer pinholes. The surface roughness is also considerable with production by single-roll liquid quenching. In a case of use where a strong bending stress is applied, such as with a main spring, then a problem has also emerged in that the bending fatigue properties are diminished due to the pinholes, magnitude of surface roughness, and the like. Metallic glasses, which among the amorphous metals have a particularly distinctly observed glass transition point, have also been developed, and the use of metallic glasses for spring materials has been studied, but similar problems as with those of amorphous metals described above also apply to metallic glasses.

An advantage of the invention is to provide a method for producing a timepiece spring, a device for producing a timepiece spring, a timepiece spring, and a timepiece, in which a metallic glass is used.

Means Used to Solve the Above-Mentioned Problems

A method for producing a timepiece spring as in the invention including: a step for producing, by casting, a metallic glass raw material constituted of a metallic glass; a step for heating the metallic glass raw material to achieve a superplastic state; and a step for rolling the metallic glass raw material in a superplastic state to produce a sheet material.

A "metallic glass" refers to a non-crystalline alloy composed primarily of metal elements, and is an amorphous metal for which the glass transition point is clearly observed. Amorphous metals not classified as metallic glass progressively crystallize during heating prior to reaching a glass transition point. A "superplastic state" refers to a state indicative of a phenomenon where, when a force is applied at a temperature well below the melting point of a given type of material, very significant stretching occurs without any adverse effect on the fundamental properties.

According to the invention, the metallic glass raw material constituted of the metallic glass produced by casting is used, and heated to achieve a superplastic state, then processed to a sheet material having a desired thickness by rolling such as where the metallic glass raw material is passed between a pair of rollers. This makes it possible to reduce pinholes, because even though pinholes might be present in the metallic glass raw material, the rolling in a superplastic state causes the surface of the metallic glass raw material to be smooth. For this reason, it is possible to eliminate any drop in the bending fatigue properties arising due to the concentration of stress caused by pinholes, and possible to greatly improve the bending fatigue properties of a timepiece spring of a configuration including the processed sheet material. Because the rolling is done in a superplastic state, the surface roughness of the sheet material can be reduced in comparison to a metallic glass raw material produced by a well-known single-roll liquid quenching process or the like. The thickness of sheet material can be precisely set by the dimensions between the rollers during rolling, and the like, and thus the thickness precision can also be enhanced.

In the method for producing a timepiece spring as in the invention, preferably, the rolling processing is carried out by passing the metallic glass raw material in a superplastic state between a pair of rotating rollers, a convexity being provided to a predetermined position on an outer peripheral surface of one roller of the pair of rollers and a concavity that fits with the convexity being provided to a position that faces the convexity on an outer peripheral surface of the other roller, and being passed between the pair of rotating rollers causes the metallic glass raw material in a superplastic state to be rolled and causes the metallic glass raw material in a superplastic state to be sandwiched between the convexity and the concavity.

According to the invention, the metallic glass is in a superplastic state during the rolling processing, and thus a shape corresponding to the sandwiching convexity and concavity can be easily processed into the sheet material obtained by rolling, because the metallic glass raw material in a superplastic state, upon being passed through the pair of rollers, is sandwiched between the convexity provided to the one roller and the concavity provided to the other roller. Examples of processing include the formation of a barrel arbor hook hole or a hole for attaching a slipping attachment, cutting the sheet material, or the like.

In the method for producing a timepiece spring as in the invention, preferably, the rolling processing is carried out by passing the metallic glass raw material in a superplastic state between a pair of rotating rollers, and the sheet material is deformed simultaneously with the processing of the sheet material by the rolling processing, by controlling the relative rotational speed of the pair of rollers.

According to the invention, the metallic glass is in a superplastic state during the rolling processing, and thus controlling the relative rotational speed of the pair of rollers makes it possible to deform the resulting sheet material to a bent state. This either obviates the need to provide a separate, later step for deforming, or reduces the work for deforming in a later step, and thus makes it possible to reduce production costs.

In the method for producing a timepiece spring as in the invention, preferably, the metallic glass raw material is a sheet of material produced by a single-roll liquid quenching process. According to the invention, the use of the sheet of material as the metallic glass raw material facilitates processing of the sheet of material in rolling into the sheet material with the rollers, and makes it possible to impart a high degree of smoothness to the surface of the resulting sheet material, because the upper surface and the lower surface are smooth. The sheet of material can also be readily produced by the single-roll liquid quenching.

In the method for producing a timepiece spring as in the invention, preferably, the metallic glass raw material is a wire of material produced by spinning in a rotating liquid. According to the invention, the use of the wire of material as the metallic glass raw material makes it possible to control the cross-sectional area with high accuracy, because the cross-section of the wire of material is circular. Then, because of the use of the wire of material for which the cross-sectional area is controlled with high accuracy, it is easy to accurately produce a sheet material having the desired width dimension when the wire of material is rolled into the sheet material by the pair of rollers. The wire of material can also be easily produced by spinning in a rotating liquid.

A method for producing a timepiece spring as in the invention including: using a cooling roll which includes a cooling section for rapidly solidifying a molten metallic glass stock material, a width dimension of the cooling section in a direction running along an axis of rotation being set to a width dimension of a sheet material of metallic glass; and ejecting the molten metallic glass stock material toward an outer peripheral surface of the cooling roll, which is rotating, and rapidly solidifying the ejected molten metallic glass stock material on the outer peripheral surface of the cooling roll to thereby form the sheet material of metallic glass.

According to the invention, the cooling roll includes the cooling section for rapidly solidifying the molten metallic glass stock material, the width dimension of the cooling section in a direction running along the axis of rotation of the cooling roll being set to the width dimension of the sheet material, and therefore the molten metallic glass stock material is rapidly solidified by the cooling section corresponding to the width dimension of the sheet material even though the ejected molten metallic glass stock material might widen in the width direction on the outer peripheral surface of the cooling section. As such, it is possible to produce the sheet material of metallic glass of the desired width dimension, easily and with high accuracy. Also, because the sheet material of metallic glass is produced at the desired width dimension with high accuracy, it is possible to obviate the need for a later step for machining or the like implemented in order to have the sheet material of metallic glass be of the desired width dimension; alternatively, it is possible to reduce the later step.

In the method for producing a timepiece spring as in the invention, preferably, guide sections formed coaxially with the cooling section are respectively provided to two sides of the cooling section, and an outer diameter of the cooling section is smaller than an outer diameter of the guide sections.

According to the invention, the guide sections formed coaxially with the cooling section are respectively provided to two sides of the cooling section, and the outer diameter of the cooling section is smaller than the outer diameter of the guide sections, and therefore even though the ejected molten metallic glass stock material might widen in the width direction on the outer peripheral surface of the cooling section, the inner side surfaces of the guide sections serve as wall surfaces, thus regulating the widening. For this reason, the width dimension of the sheet material of metallic glass being formed will not widen beyond the width dimension of the cooling section. As such, the use of the cooling roll described above makes it possible to produce the sheet material of metallic glass of the width dimension corresponding to the width dimension of the cooling section, easily and with high accuracy. Also, the molten metallic glass stock material comes into contact and is cooled by the wall surfaces created by the inner side surfaces of the guide sections, and thus it is possible to produce a sheet material of metallic glass having smooth, neat side surfaces.

In the method for producing a timepiece spring as in the invention, preferably, guide sections formed coaxially with the cooling section are respectively provided to two sides of the cooling section, and an outer diameter of the cooling section is greater than an outer diameter of the guide sections.

According to the invention, the guide sections formed coaxially with the cooling section are respectively provided to two sides of the cooling section, and the outer diameter of the cooling section is greater than the outer diameter of the guide sections, and therefore even though the ejected molten metallic glass stock material might widen in the width direction on the outer peripheral surface of the cooling section, the portion that overflows beyond the cooling section flows down toward the guide sections, and thus the width dimension of the sheet material of metallic glass being formed will not widen beyond the width dimension of the cooling section. As such, the use of the cooling roll described above makes it possible to produce the sheet material of metallic glass of the width dimension corresponding to the width dimension of the cooling section, easily and with high accuracy. Because of the adoption of a configuration where the cooling section projects out beyond the guide sections on both sides, it is easy to carry out maintenance for removing any residual metallic glass stock material that has adhered to the outer peripheral surface of the cooling section in the steps for producing the sheet material of metallic glass.

In the method for producing a timepiece spring as in the invention, preferably, the cooling section is formed so that the width dimension becomes smaller going toward the direction of the center of the axis of rotation of the cooling roll.

According to the invention, the cooling section is formed so that the width dimension becomes smaller going toward the direction of the center of the axis of rotation of the cooling roll, and therefore the angle of intersection between the outer peripheral surface of the cooling section and the side surfaces of the cooling surface forms an acute angle. For this reason, the molten metallic glass stock material is good in leaving from the outer periphery, when the molten metallic glass stock material flows down on the guide section sides from the outer peripheral surface of the cooling roll, and also it is possible to prevent dripping for the portion of the ejected molten metallic glass stock material that overflows beyond the cooling section. Thus, the accuracy of the width dimension of the sheet material of the metallic glass can be even further enhanced.

In the method for producing a timepiece spring of the invention, preferably, the cooling roll is provided with a first roll constituting the cooling section and two second rolls which are respectively adjacent to two sides of the first roll and constitute the guide sections, and the first roll and the two second rolls rotate in respectively opposite directions.

According to the invention, any portion where the ejected molten metallic glass stock material widens in the width direction on the outer peripheral surface of the cooling roll and overflows beyond the first roll constituting the cooling section flows down toward the second rolls constituting the guide sections. Because the second rolls rotate in a direction opposite to that of the first roll, the molten metallic glass stock material having flowed down toward the second rolls is discharged by the centrifugal force of the second rolls in a direction on the side opposite to the direction of the sheet material of metallic glass being formed on the outer peripheral surface of the first roll. For this reason, it is easy to recover the stock material that has flowed down.

A device for producing a timepiece spring as in the invention ejects a molten metallic glass stock material toward an outer peripheral surface of a rotating cooling roll and causes the ejected molten metallic glass stock material to be rapidly cooled on the outer peripheral surface of the cooling roll to thereby form a sheet material of metallic glass, wherein the device for producing a timepiece spring is characterized in that the cooling roll includes a cooling section for rapidly solidifying the molten metallic glass stock material, a width dimension of the cooling section in a direction running along an axis of rotation of the cooling roll being set to a width dimension of the sheet material.

According to the invention, the cooling roll includes the cooling section for rapidly solidifying the molten metallic glass stock material, the width dimension of the cooling section in a direction running along the axis of rotation of the cooling roll being set to the width dimension of the sheet material, and therefore the molten metallic glass stock material is rapidly solidified by the cooling section corresponding to the width dimension of the sheet material even though the ejected molten metallic glass stock material might widen in the width direction on the outer peripheral surface of the cooling section. As such, it is possible to produce the sheet material of metallic glass of the desired width dimension, easily and with high accuracy. Also, because the sheet material of metallic glass is produced at the desired width dimension with high accuracy, it is possible to obviate the need for a later step for machining or the like implemented in order to have the sheet material of metallic glass be of the desired width dimension; alternatively, it is possible to reduce the later step.

A timepiece spring of the invention is obtained by the method for producing a timepiece spring. According to the invention, even in a case where pinholes are present in the metallic glass raw material, the rolling in a superplastic state reduces the pinholes, and also reduces the surface roughness that arises due to the method for producing the metallic glass raw material; therefore, it is possible to provide a timepiece spring having considerably enhanced bending fatigue properties. Also, the cooling roll having the cooling section set to a width dimension that corresponds to the desired width dimension is used to produce the sheet material of metallic glass of the desired width dimension, easily and with high accuracy, and therefore it is possible to obviate the need for a later step for machining or the like implemented in order to have the sheet material of metallic glass be of the desired width dimension or alternatively it is possible to reduce the later step. Consequently, it is possible to provide a timepiece spring which includes a sheet material of metallic glass that is of the desired width dimension and highly accurate and which is excellent in terms of production costs. Illustrative examples of a timepiece spring include a main spring, a balance spring, a fixing spring, and the like.

A timepiece of the invention includes the timepiece spring being used. According to the invention, because the timepiece spring having considerably enhanced bending fatigue properties is used, it is possible to provide a timepiece having a long fatigue life and excellent durability.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

Figure 1:
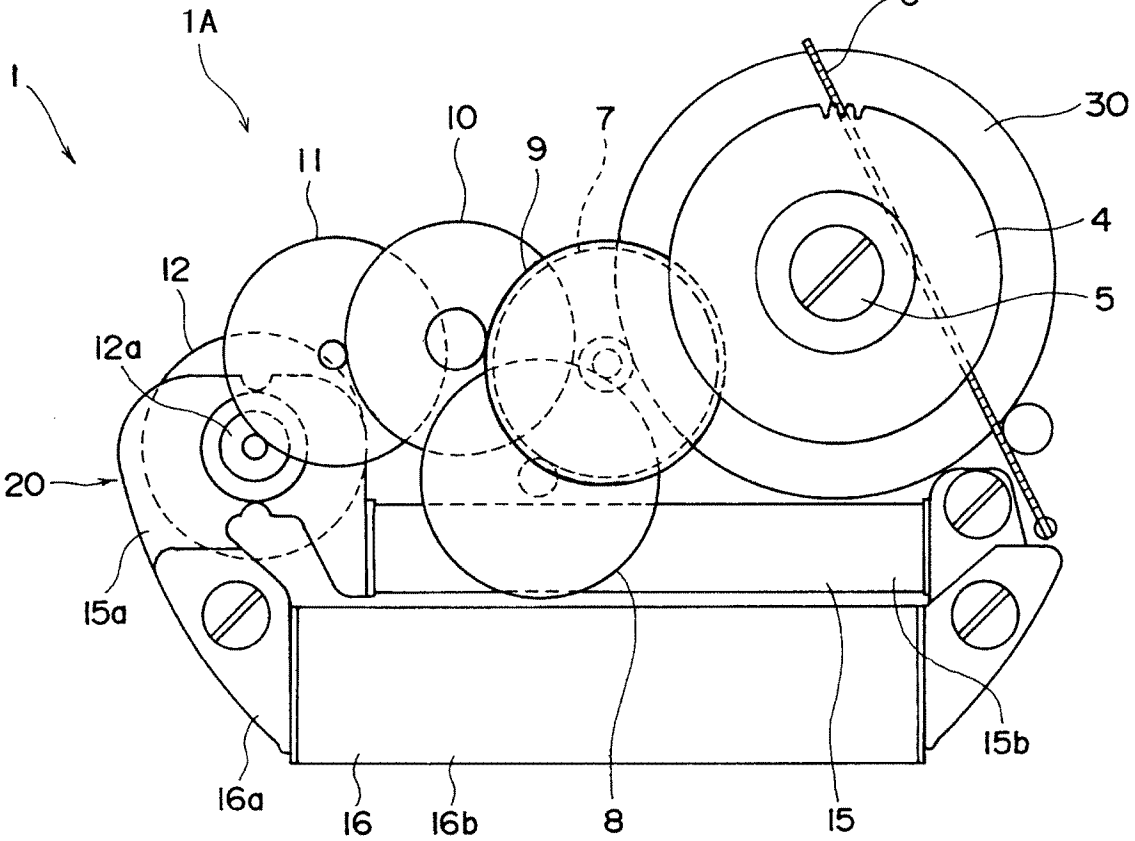
FIG. 1 is a plan view illustrating a drive mechanism of an electronically controlled mechanical timepiece in which a main spring constituted of a metallic glass sheet material is used, according to a first embodiment of the invention.
Figure 2:
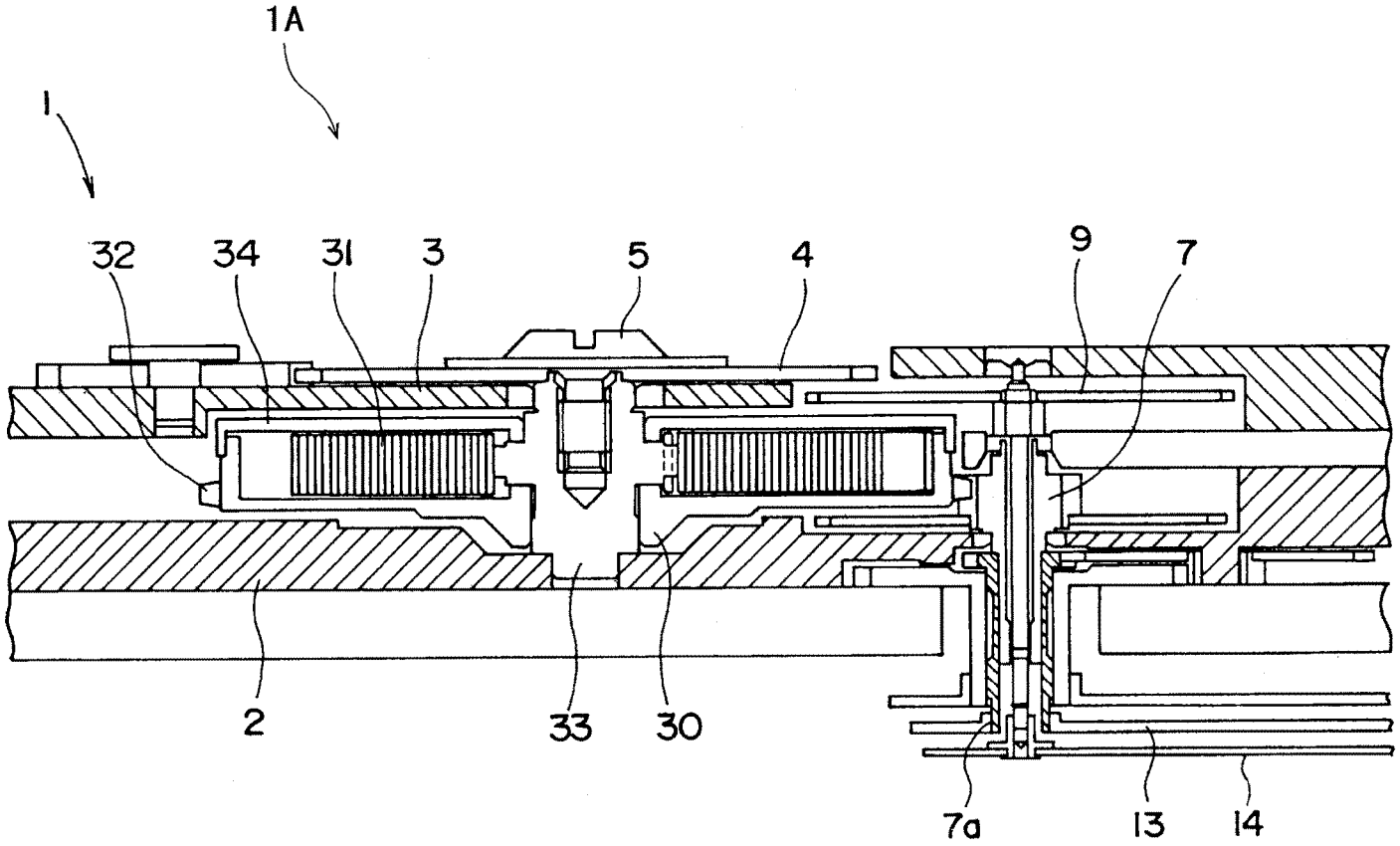
FIG. 2 is a cross-sectional view of the drive mechanism of FIG. 1.
Figure 3:
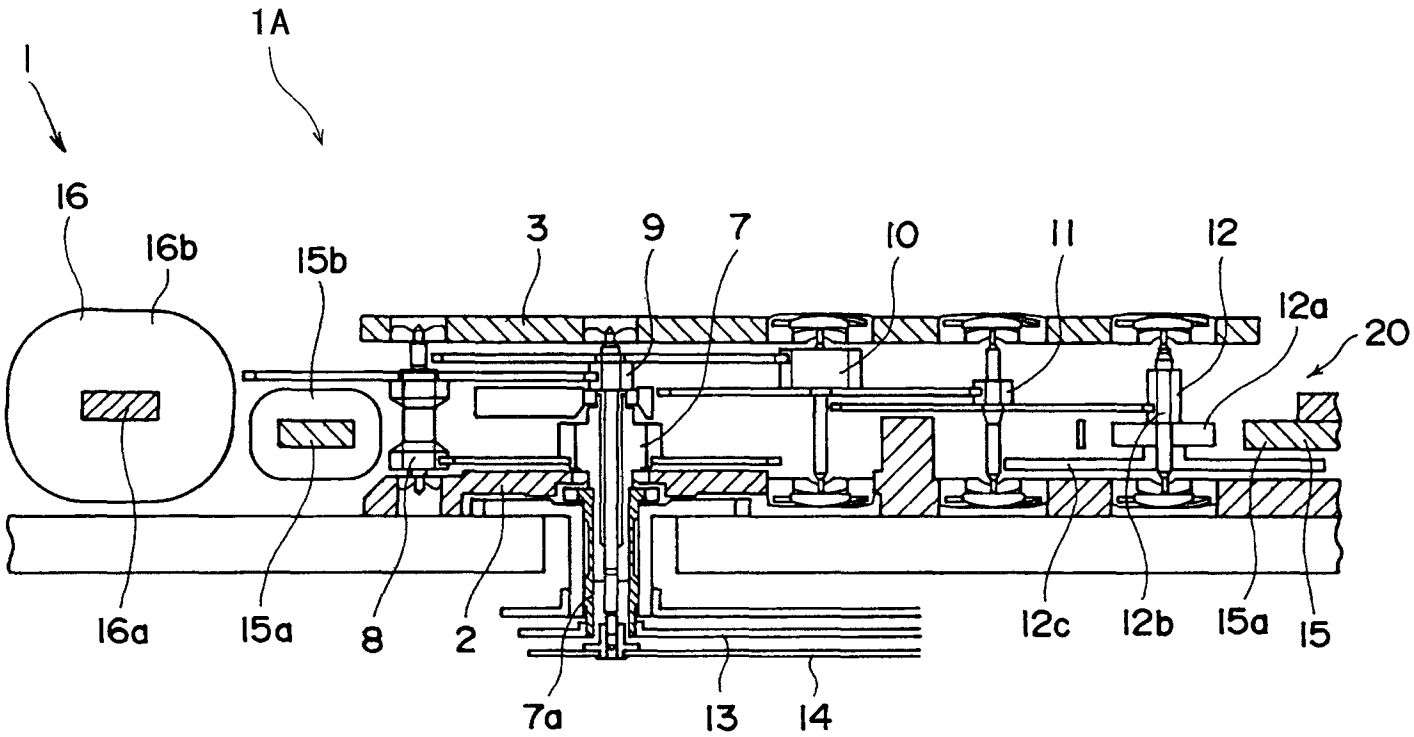
FIG. 3 is another cross-sectional view of the drive mechanism of FIG. 1.

The first embodiment as in the invention shall be described below on the basis of the accompanying drawings. The first embodiment relates to a drive mechanism in which a timepiece spring as in the invention is used as a main spring. FIG. 1 is a plan view illustrating a drive mechanism 1A of an electronically controlled mechanical timepiece 1 in which a main spring constituted of a metallic glass sheet material is used, according to a first embodiment of the invention. FIG. 2 is a cross-sectional view of the drive mechanism 1A of FIG. 1. FIG. 3 is another cross-sectional view of the drive mechanism 1A of FIG. 1.

The drive mechanism 1A of the electronically controlled mechanical timepiece 1 is provided with a barrel 30 including a metallic glass main spring 31, a barrel gear wheel 32, a barrel arbor 33, and a barrel cover 34. The metallic glass main spring 31 has an outer end that is fixed to the barrel gear wheel 32 and an inner end that is fixed to the barrel arbor 33. The barrel arbor 33 is supported by a base plate 2 and a train wheel bridge 3, and is fixed by a ratchet screw 5 so as to rotate integrally with a ratchet wheel 4. The ratchet wheel 4 is meshed with a click 6 so as to rotate in the clockwise direction but not rotate in the counterclockwise direction. A method for rotating the ratchet wheel 4 in the clockwise direction and winding the metallic glass main spring 31 is similar to the automatic winding or manual winding of a mechanical timepiece, and thus a description has been omitted.

The rotation of the barrel gear wheel 32 is sent to a second wheel 7 with a seven-fold increase in speed, and then sent in sequence to a third wheel 8 with a 6.4-fold increase in speed, to a fourth wheel 9 with a 9.375-fold increase in speed, to a fifth wheel 10 with a three-fold increase in speed, to a sixth wheel 11 with a ten-fold increase in speed, and to a rotor 12 with a 10-fold increase in speed, thus giving a total 126,000-fold increase in speed; these gear wheels constitute a train wheel. A cannon pinion 7*a* is fixed to the second wheel 7; a minute hand 13 is fixed to the cannon pinion 7*a*; and second hand 14 is fixed to the fourth wheel 9. As such, in order to cause the second wheel 7 to rotate at 1 rph and to cause the fourth wheel 9 to rotate at 1 rpm, it suffices to control the rotor 12 so as to rotate at 5 rps. The barrel gear wheel 32 in such a case will be at 1/7 rph.

The electronically controlled mechanical timepiece 1 is provided with a power generator 20 constituted of the rotor 12, a stator 15, and a coil block 16. The rotor 12 is constituted of a rotor magnet 12*a*, a rotor pinion 12*b*, and a rotor inertia disk 12. The rotor inertia disk 12 is intended to reduce fluctuation in the rotational speed of the rotor 12 in relation to fluctuation in the drive torque coming from the barrel 30. The stator 15, in turn, is obtained by winding 40,000 turns of a stator coil 15*b* around a stator body 15*a*. The coil block 16 is obtained by winding 110,000 turns of a coil 16*b* around a magnetic core 16*a*. Herein, the stator body 15*a* and the magnetic core 16*a* are constituted of PC permalloy or the like. The stator coil 15*b* and the coil 16*b* are connected in series so that output voltages to which respective generated voltages have been added are issued forth. Though a depiction has been omitted in FIGS. 1 to 3, an alternating current output generated by the power generator 20 of such description is supplied to a control circuit incorporated in order to control the speed governance, escapement, and the like of the drive mechanism 1A.

Figure 4A:
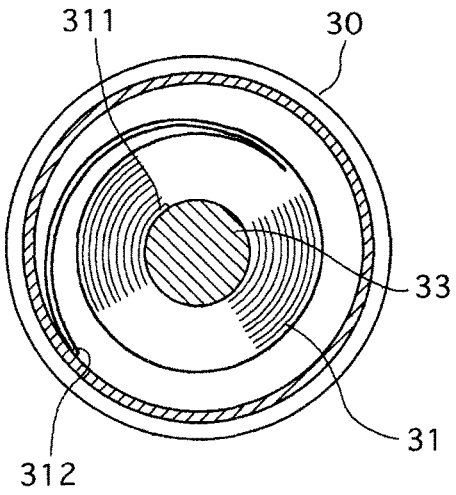
FIG. 4A is a plan view illustrating the main spring, housed in a barrel, of FIG. 1, the main spring being in a wound and fastened state.
Figure 4B:
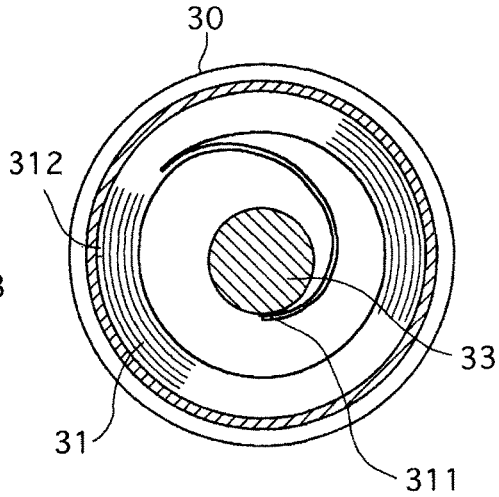
FIG. 4B is a plan view illustrating the main spring, housed in a barrel, of FIG. 1, the plan view being of a state after the main spring has been let down.

An internal structure of the barrel 30 shall be described next, on the basis of FIGS. 4A and 4B. FIG. 4A is a plan view illustrating a main spring housed in a barrel, the main spring being in a wound and fastened state within the barrel. FIG. 4B is a plan view illustrating the main spring housed in the barrel, the plan view being of a state after the main spring has been let down within the barrel. The dimensions of the shape of the metallic glass main spring 31 can be width b=1 mm, thickness t=0.1 mm, and full length L=300 mm. The timepiece spring in which the metallic glass main spring 31 is formed can be such that a rectangular cross-section is formed by wire-drawing of a wire of metallic glass.

The metallic glass main spring 31 has an inner end 311 that is wound in a spiral (helical) shape about the barrel arbor, as well as an outer end 312 that is fixedly joined to an inside surface of the barrel 30. In the state illustrated in FIG. 4B, an external force causes the barrel 30 to rotate in relation to the barrel arbor 33, thus winding and fastening the metallic glass main spring 31. After the winding and fastening, however, when the restrained state of the barrel 30 is released, the barrel 30 rotates together with the letting down of the metallic glass main spring 31. The train wheel, such as the second wheel 7, is then rotated by the barrel gear wheel 32, which is formed on the outer periphery of the barrel 30, thus causing the minute hand 13, the second hand 14, and the like to operate.

Figure 5:
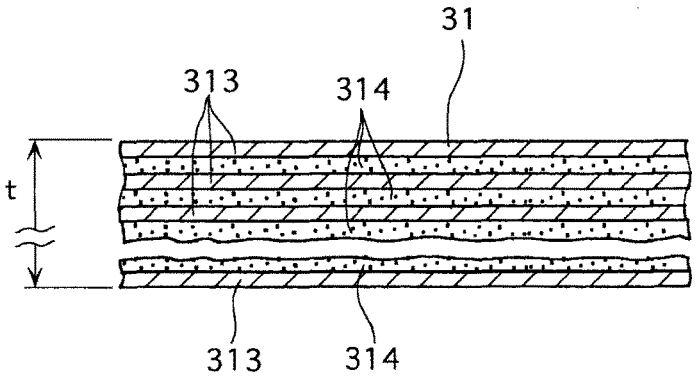
FIG. 5 is a cross-sectional view taken along the thickness direction of a metallic glass main spring, formed by integrally layering together a plurality of layers of the metallic glass sheet material.

FIG. 5 is a cross-sectional view taken along the thickness direction of the metallic glass main spring 31, formed by integrally layering together a plurality of layers of a metallic glass sheet material 313. The metallic glass main spring 31 can include a metallic glass sheet material 313 including single sheets that have a thickness t of 0.1 mm, and also can be formed by integrally layering together a plurality of layers of a metallic glass sheet material 313 having a thickness of 50 μm, in which case the metallic glass main spring 31 would be configured by bonding together each of the metallic glass substrates 313 using an epoxy-based adhesive 314.

Figure 6:
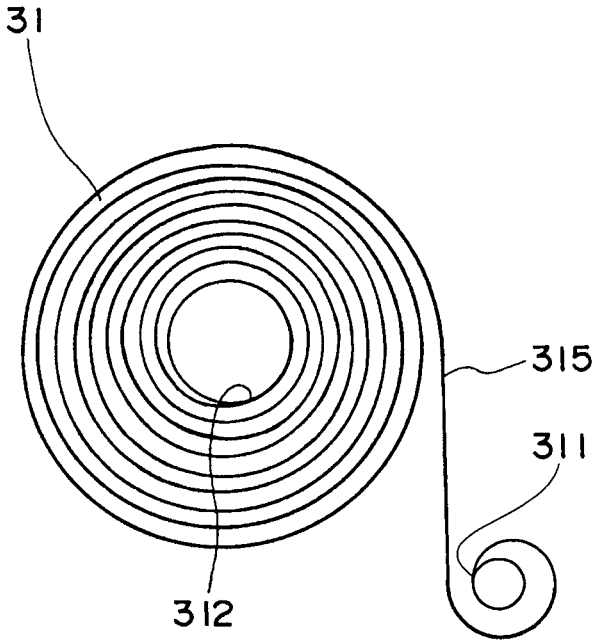
FIG. 6 is a plan view illustrating a freely deployed state of the metallic glass main spring.

FIG. 6 is a plan view illustrating a freely deployed state of the main spring. The metallic glass main spring 31, having been removed from the barrel 30, is deformed on the side opposite to the direction of take-up in relation to the barrel arbor 33; in terms of shape, the freely deployed shape is substantially S-shaped as seen in plan view. Then, an inflection point 315 where the direction of bending changes is formed in the vicinity of the inner end 311; the region spanning from the inflection point 315 until the inner end 311 is used to fix the metallic glass main spring 31 to the barrel arbor 33.

In the formation of the metallic glass main spring 31 as above, firstly, the metallic glass raw material is produced by casting.

(Configuration of the Metallic Glass Raw Material)

The metallic glass raw material is constituted of a metallic glass. A metallic glass is an amorphous alloy which is primarily composed of metal elements and includes elements that satisfy a predetermined condition, in which alloy there is no regularity to the arraying of elements and elements are arrayed in a random fashion. Such a metallic glass is formed when a stock material in a molten state is cooled at a rapid cooling rate. Amorphous metals not classified as metallic glass progressively crystallize during heating prior to reaching a glass transition point, whereas a glass transition point is observed with metallic glasses. Metallic glasses having such a physical nature possess the properties of having a high wear resistance, high strength, low Young's modulus, and high corrosion resistance.

Examples that could be employed as a metallic glass for the metallic glass raw material described above include metallic glasses such as an La-based alloy, an Mg-based alloy, a Pd-based alloy, a Zr-based alloy, an Fe-based alloy, a Co-based alloy, a Cu—Zr-based alloy, a Cu—Hf-based alloy, a Cu—Zr—Be based alloy, or an Ni-based alloy, but a variety of metallic glasses could be employed depending on the required performance for the spring. Preferably, the metallic glass raw material is a sheet of material produced by single-roll liquid quenching (single-role quenching). Single-roll liquid quenching is described below.

(Single-Roll Liquid Quenching)

Figure 7:
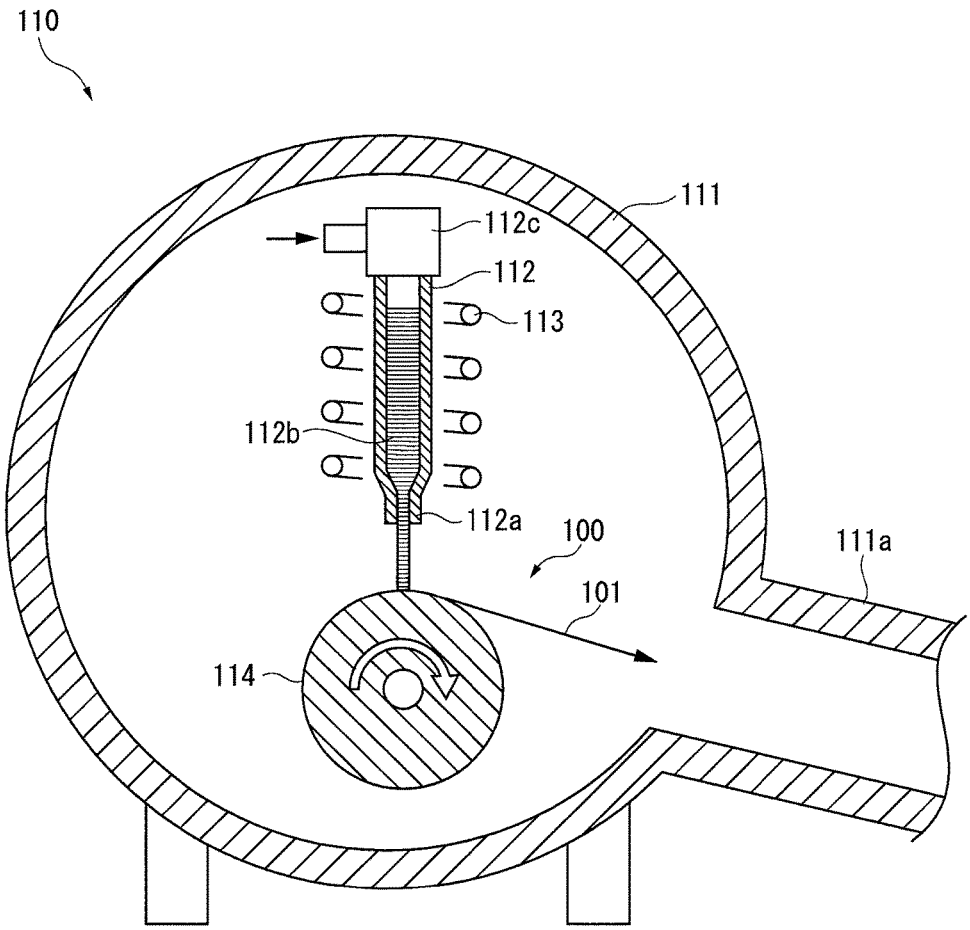
FIG. 7 is a schematic diagram illustrating a configuration of a single-roll liquid quenching device used in the production of a sheet-shaped material.

FIG. 7 is a schematic diagram illustrating a configuration of a single-roll liquid quenching device 110 used in a production of the sheet of material 101. The single-roll liquid quenching device 110 illustrated in FIG. 7 is provided with: a chamber 111; a quartz tube 112 which is provided within the chamber 11, as at a lower end a nozzle 112*a*, and is able to hold in the interior a metallic glass stock material 112*b*; high-frequency heating coils 113 arranged on the outer periphery of the quartz tube 112; and a cooling roll 114 which is provided below the quartz tube 112 on the line of extension of the axis of the quartz tube 112 and is able to rotate at a high speed.

The chamber 111 has a depressurizing means (not shown), whereby the inside of the chamber 111 can be depressurized. A flight tube 111*a* for air-cooling the metallic glass raw material 100 being formed is provided to a side surface of the chamber 111. Having been issued forth from the cooling roll 114, the metallic glass raw material 100 is air-cooled by flying at high speed while passing through the interior of the flight tube 111*a*. The flight tube 111*a* is provided at a length of several meters. The quartz tube 112 has a gas supplying means 112*c* for supplying an inert gas to the interior of the quartz tube 112 from above. The cooling roll 114 has a cooling means (not shown), whereby the cooling roll can be maintained in a desired temperature range. The cooling roll 114 rotates in the direction of the arrow in FIG. 7. The rotational speed is preferably 4,000 rpm or more. The constituent material of the cooling roll 114 is preferably a material having excellent heat resistance and thermal conductivity, examples of which include copper, silver, gold, platinum, aluminum, and the like.

A method for producing the sheet of material (ribbon) 101, which is the metallic glass raw material 100, using the single-roll liquid quenching device 110 illustrated in FIG. 7 shall now be described. Firstly, a constituent element material for obtaining the metallic glass of the invention is weighed according to the content of each of the aforementioned constituent elements, to then serve as the metallic glass stock material 112*b*. The metallic glass stock material 112*b* is housed in the quartz tube 112. The inside of the chamber 111 is then depressurized by the depressurizing means. Next, the high-frequency heating coils 113 are energized to heat the metallic glass stock material 112*b* inside the quartz tube 112 to a predetermined temperature. The metallic glass stock material 112*b* is thereby melted. Next, the molten metallic glass stock material 112*b* is ejected to the outer peripheral surface of the cooling roll 114 from the nozzle 112*a* of the quartz tube 112, due to the gas pressure being supplied into the quartz tube 112 by the gas supplying means.

Having been ejected from the nozzle 112*a* of the quartz tube 112, the metallic glass stock material 112*b* comes into contact with the outer peripheral surface of the cooling roll 114 and is cooled rapidly by exchanging heat with the outer peripheral surface of the cooling roll 114. Each of the atoms present in a random fashion within the melt thereby reaches solidification in a state where the random arrangement thereof is upheld. The solidified metallic glass is continuously discharged in a tangential direction by the centrifugal force of the rotating cooling roll 114. A ribbon of the sheet of material 101 of the metallic glass is thereby obtained. The ribbon of the sheet of material 101 of the metallic glass being discharged continuously from the cooling roll 114 passes through the interior of the flight tube 111*a* of the side surface of the chamber 111 and is air-cooled by flying at high speed. Preferably, the ribbon of the sheet of material 101 of the metallic glass is taken up using a take-up roll (not shown) or the like.

Controlling the amount of molten metallic glass stock material 112*b* that is ejected, controlling the viscosity of the molten metallic glass stock material 112*b*, and the like also makes it possible to control the sheet of material 101 to a desired thickness. The amount of molten metallic glass stock material 112*b* that is ejected is controlled by adjusting the gas flow rate being supplied by the gas supplying means 112*c* and altering the gas pressure in the quartz tube 112. The viscosity of the molten metallic glass stock material 112*b* is controlled by adjusting the voltage of the high-frequency heating coils 113 and altering the heating temperature, thereby altering the temperature of the molten metallic glass stock material 112*b* in the quartz tube 112. Adjusting the width of the nozzle 112*a* of the quartz tube 112 also makes it possible to adjust, to some degree, the width of the resulting sheet of material 101 of the metallic glass.

Voids (pinholes) formed by the solidification in a state where air remains at the surface or in the interior are present in the ribbon of the sheet of material 101 of the metallic glass obtained by the single-roll liquid quenching described above. Also, the ribbon of the sheet of material 101 of the metallic glass obtained by the single-roll liquid quenching is not surface-treated, and thus has considerable surface roughness.

(Heating the (Sheet of Material of) the Metallic Glass Raw Material)

Figure 8:
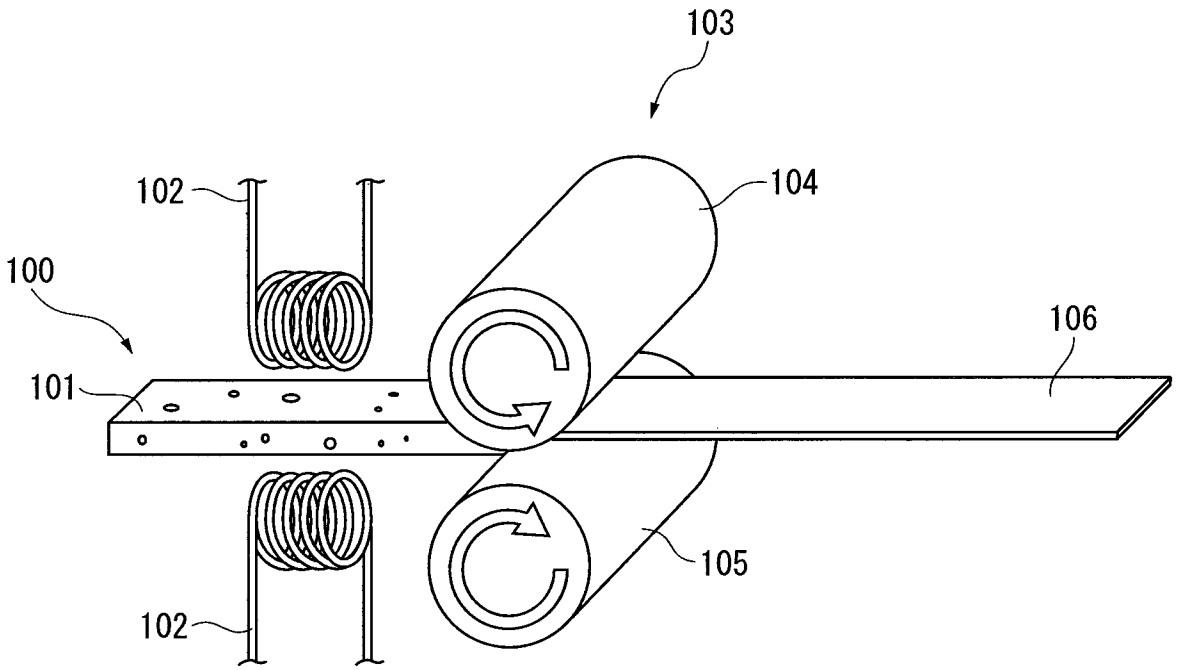
FIG. 8 is a schematic diagram illustrating a heating and rolling step of a method for producing a metallic glass sheet material of the invention.

FIG. 8 is a schematic diagram illustrating a heating and rolling step of a method for producing the metallic glass sheet material of the invention. The sheet of material 101, serving as the metallic glass raw material 100, is heated so as to reach a superplastic state. In FIG. 8, as the heating means, heaters 102 constituted of a resistive heating heater are arranged above and below the sheet of material 101 not yet fed to a rolling means. The arrangement of the heaters 102 above and below the sheet of material 101 allows for the sheet of material 101 to be heated evenly from above and below.

Figure 9:
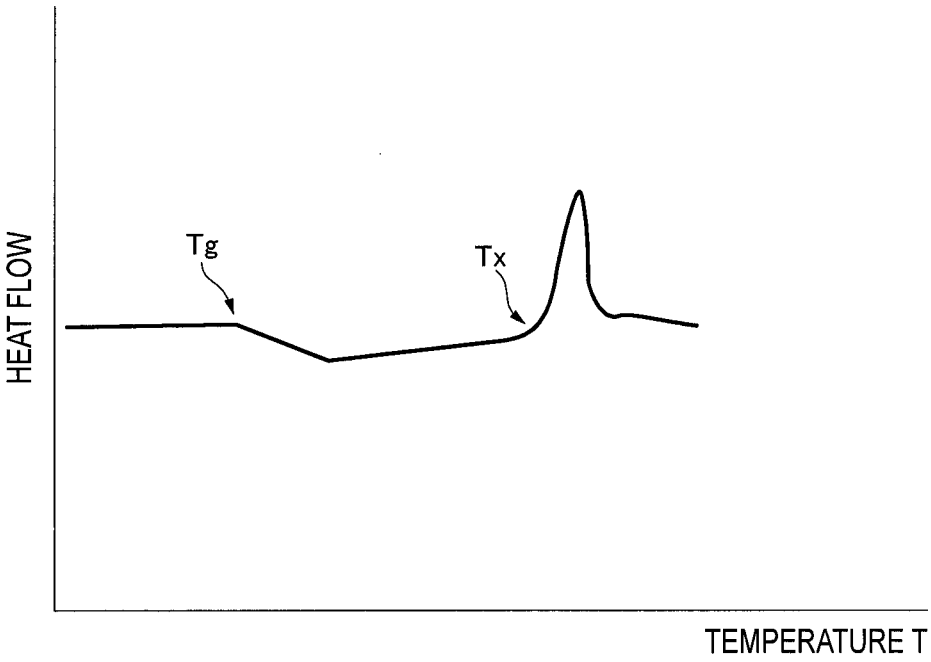
FIG. 9 is a calorimetric curve for describing a superplastic region of the metallic glass.

FIG. 9 is a calorimetric curve for describing a superplastic region of the metallic glass. As illustrated in FIG. 9, while the metallic glass is being gradually heated, the glass transition temperature (Tg), indicative of heat absorption, appears, and is followed by the crystallization temperature (Tx), indicative of heat generation. In addition, as heating proceeds beyond the crystallization temperature, the melting point (not shown) is reached. A superplastic region of the metallic glass exhibiting a superplastic state is a temperature region ranging from the vicinity of the glass transition point (Tg) to less than the crystallization temperature (Tx). The heating in the method of production of the invention is carried out so that the sheet of material 101 reaches a temperature included in the superplastic region spanning from the vicinity of the glass transition temperature (Tg) to less than the crystallization temperature (Tx). In the superplastic region, the metallic glass exhibits a superplastic state; the metallic glass becomes a syrup, in a state that offers a great deal of workability.

Raising a Ni-based alloy by way of example, the glass transition temperature (Tg) is 573° C. and the crystallization temperature (Tx) is 624° C. These temperatures vary somewhat depending on the heating rate conditions during measurement, and the like. The range 550° C. to 600° C. is preferable as a heating temperature suitable for achieving a superplastic state in metallic glass constituted of an Ni-based alloy having the physical nature described above.

(Rolling Process for the (Sheet of Material of) the Metallic Glass Raw Material)

Returning now to FIG. 8, the sheet of material 101 having been heated by the heaters 102, which are the heating means, to reach the superplastic state is rolled to produce the sheet material 106. The rolling is carried out by passing the sheet of material 101 in the superplastic state between a rotating pair of rollers 104, 105 serving as a rolling means 103. One roller 104 and another roller 105, which together constitute the pair of rollers 104, 105, are formed to each have a smooth outer peripheral surface. The interval occurring between the pair of rollers 104, 105 will be equivalent to the thickness of the sheet material 106 being formed, and thus it is preferable for the pair of rollers 104, 105 to be arranged so as to allow for the interval to be altered in accordance with the desired thickness of the sheet material 106 being formed. The rotation of the pair of rollers 104, 105 during rolling is preferably such that the one roller 104 and the other roller 105 each are rotated so as to be at the same rotational speed.

The sheet material 106 of the metallic glass obtained by finishing the rolling is cooled to the glass transition temperature (Tg) or lower. The cooling herein can be slow cooling, such as natural cooling, or can be forced cooling in which a cooling means, such as water-cooling with water or the like or air-cooling, is used.

The sheet material 106 of the metallic glass obtained by this method of production is then processed to the width and length dimensions needed for use as a power source for the drive mechanism 1A. In the case of a sheet material 106 of the metallic glass which includes a single sheet of a thickness t (0.1 mm) necessary for the metallic glass main spring 31, deforming is carried out by winding the metallic glass main spring 31 around a round bar or the like. In the case where the metallic glass main spring 31 is deformed, it is sufficient to carry out the deforming by carrying out a heat treatment with a temperature of 150° or higher. In the case of a plurality of layers that are layered and integrated, as is illustrated in FIG. 5, then each of the metallic glass sheet materials 313 is bonded together using the epoxy-based adhesive 314 to ensure the thickness t (0.1 mm) necessary for the metallic glass main spring 31. Finally, before the epoxy-based adhesive 314 is cured, deforming is carried out by winding the metallic glass main spring 31 about a round bar or the like, and then the epoxy-based resin 314 is cured.

(Actions and Effects of the First Embodiment)

(1) According to the present embodiment, the metallic glass raw material 100 (sheet of material 101) constituted of the metallic glass is used, heated to enter a superplastic state, and then rolled to produce the sheet material 106 of the metallic glass. Rolling in the superplastic state causes the surface of the sheet of material 101 to be even, and smoothes the surface, and thus even in a case where voids are present as recesses in the surface of the sheet of material 101, the voids are reduced in number, and the recesses caused by the voids can be reduced. It is further possible to reduce the surface roughness of the sheet material 106 and reduce any scratches present on the surface. Because in this manner the number of voids, where stress is concentrated, is reduced and recesses caused by the voids are also reduced, it is possible to eliminate the decrease in the bending fatigue properties that is caused by stress concentration due to the voids.

(2) Rolling in the superplastic state crushes the sheet of material 101 in the thickness direction, and therefore in a case where there are voids present in the interior of the sheet of material 101, the voids in the interior are deformed into a flat shape. Stress is more dispersed for flat, deformed interior voids in comparison to the stress generated in undeformed interior voids, and thus in this regard, too, the bending fatigue properties can be enhanced. The thickness of sheet material 106 can be precisely set by the dimensions between the rollers during rolling, and the like, and thus the thickness precision can also be enhanced.

(3) The use of the sheet of material 101 as the metallic glass raw material 100 facilitates processing of the sheet of material 101 is more easily processed when rolled into the sheet material 106 by the rollers 104, 105, and makes it possible to impart a higher degree of flatness to the surface of the resulting sheet material 106, because the upper surface and lower surface are flat. The sheet of material 101 can also be readily produced by the single-roll liquid quenching.

(4) The metallic glass main spring has a low Young's modulus, and thus the torque curve of the main spring can be flattened. Because the metallic glass main spring 31 having the aforementioned properties is employed as the power source of the drive mechanism 1A, the time precision can also be enhanced.

(5) The metallic glass main spring has a high tensile stress and low Young's modulus, and thus the energy stored in the main spring can be increased. Because the metallic glass main spring 31 having the aforementioned properties is employed as the power source of the drive mechanism 1A, the drive mechanism 1A can be reduced in scale, and also the drive mechanism 1A can be operated for a longer time.

(6) The position of the inflection point 315 can be set to be in the vicinity of the inner end 311, and thus the deforming can be carried out spanning substantially the full length of the metallic glass main spring 31, and the mechanical energy stored by the metallic glass main spring 31 can be increased and the operation of the drive mechanism 1A can be sustained for even longer. There is little fluctuation in the torque with the metallic glass main spring 31, and thus the drive precision is enhanced in a case where the metallic glass main spring 31 is employed as the power source of a mechanical timepiece.

In the present embodiment, the metallic glass main spring 31 was used as the power source of the drive mechanism 1A of the electronically controlled mechanical timepiece 1, but there is no limitation thereto, and the metallic glass main spring 31 can be used in the driving mechanism of an ordinary mechanical timepiece in which the control system is constituted of a speed governor and an escapement.

Second Embodiment

In the embodiment described above, the sheet of material 101 having been produced by single-roll liquid quenching was used as the metallic glass raw material 100 for producing the sheet material 106 for the metallic glass main spring 31, but in the present embodiment, a wire of material produced by spinning in a rotating liquid is used. The spinning in a rotating liquid shall be described below.

(Spinning in a Rotating Liquid)

Figure 10:
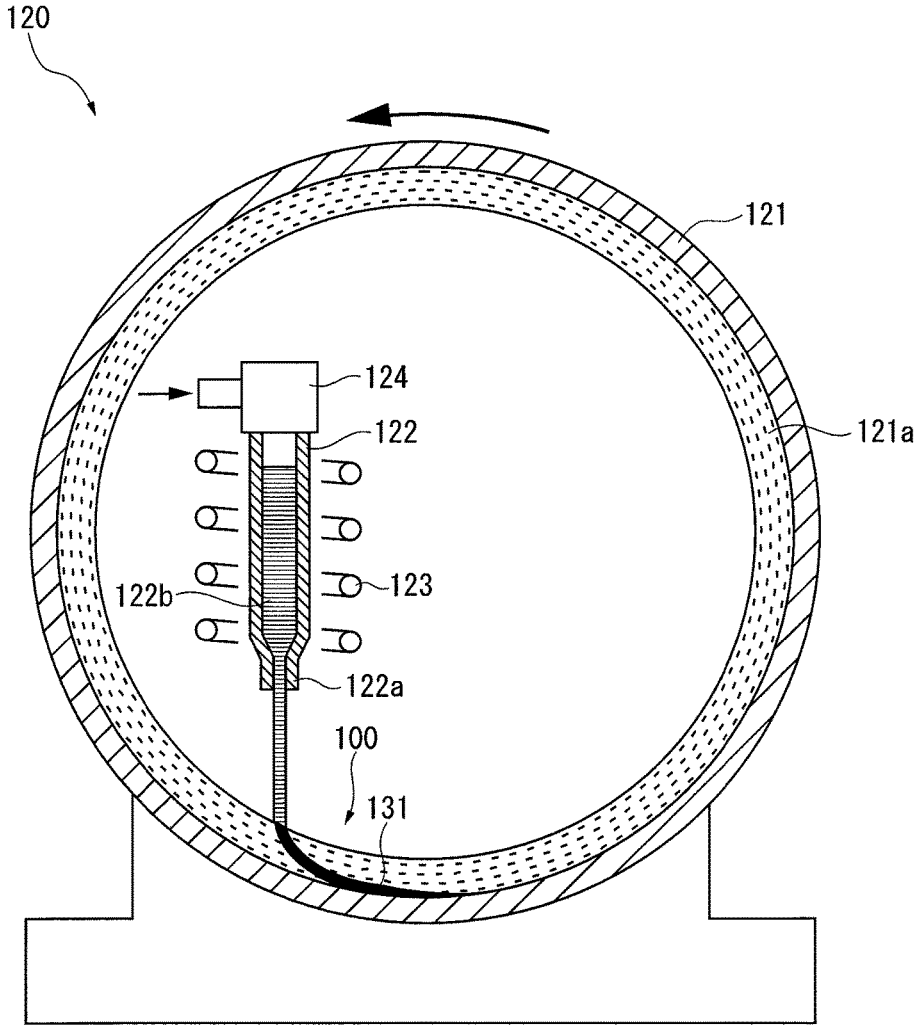
FIG. 10 is a schematic diagram illustrating a configuration of a device for spinning in a rotating liquid used in the production of a wire of material.

FIG. 10 is a schematic diagram illustrating a configuration of a device 120 for spinning in a rotating liquid used in the production of the wire of material 131; The device 120 for spinning in a rotating liquid illustrated in FIG. 10 is provided with: a cylindrical, rotatable drum 121; a quartz tube 122 which has a nozzle 122*a* at a lower end and is able to hold a metallic glass stock material 122*b* in the interior; and high-frequency heating coils 123 arranged on the outer periphery of the quartz tube 122. Outflow prevention plates (not shown) for preventing outflowing of a cooling liquid supplied to the interior are formed on both surfaces of the drum 121. The drum 121 has a cooling liquid supplying means (not shown) for supplying the cooling liquid to the inside of the drum 121. The drum 121 rotates in the direction of the arrow in FIG. 10. The quartz tube 122 has a gas supplying means 124 for supplying an inert gas to the interior of the quartz tube 122 from above.

A method for producing the wire of material 131 using the device 120 for spinning in a rotating liquid illustrated in FIG. 10 shall now be described. Firstly, a constituent element material for obtaining the metallic glass of the invention is weighed according to the content of each of the aforementioned constituent elements, to then serve as the metallic glass stock material 122*b*. The metallic glass stock material 122*b* is housed in the quartz tube 122. The drum 121 is then rotated and, when the rotational speed reaches a predetermined value, the cooling liquid is supplied to the inner surface of the drum 121 from the cooling liquid supplying means. The supplied cooling liquid forms a liquid layer 12*a* due to centrifugal force, and outflowing from the drum 121 is also prevented by the outflow prevention plates.

Next, the high-frequency heating coils 123 are energized and the metallic glass stock material 122*b* within the quartz tube 122 is heated to a predetermined temperature. The metallic glass stock material 122*b* is thereby melted. Next, the molten metallic glass stock material 122*b* is ejected to the liquid layer 121*a* inside the drum 121 from the nozzle 122*a* of the quartz tube 122, due to the gas pressure being supplied into the quartz tube 122 by the gas supplying means. Having been ejected from the nozzle 122*a* of the quartz tube 122, the metallic glass stock material 122*b* is rapidly cooled, the cross-sectional shape thereof becoming round, due to the surface tension inside the liquid layer 121 and the like. Each of the atoms present in a random fashion within the melt thereby reaches solidification in a state where the random arrangement thereof is upheld. The solidified metallic glass is continuously formed along the rotation of the drum 121. The wire of material 131 of the metallic glass is thereby obtained. Preferably, the cooling speed of the metallic glass stock material 122*b* is about 2.5 m/s.

Controlling the speed at which the cooling liquid of the liquid layer 121*a* flows, controlling the amount of molten metallic glass stock material 122*b* that is ejected, controlling the viscosity of the molten metallic glass stock material 122*b*, and the like makes it possible to control the wire of material 131 to a desired diameter. The speed at which the cooling liquid of the liquid layer 121*a* flows is controlled by altering the amount of the cooling liquid that is supplied into the drum 121, or the rotation of the drum 121. The amount of the molten metallic glass stock material 122*b* that is ejected is controlled by adjusting the gas flow rate supplied by the gas supplying means, to alter the gas pressure in the inside of the quartz tube 122. The viscosity of the molten metallic glass stock material 122*b* is controlled by adjusting the voltage of the high-frequency heating coils 123 and altering the heating temperature, thereby altering the temperature of the molten metallic glass stock material 122*b* in the quartz tube 122.

(Heating the (Wire of Material of) the Metallic Glass Raw Material)

Figure 11:
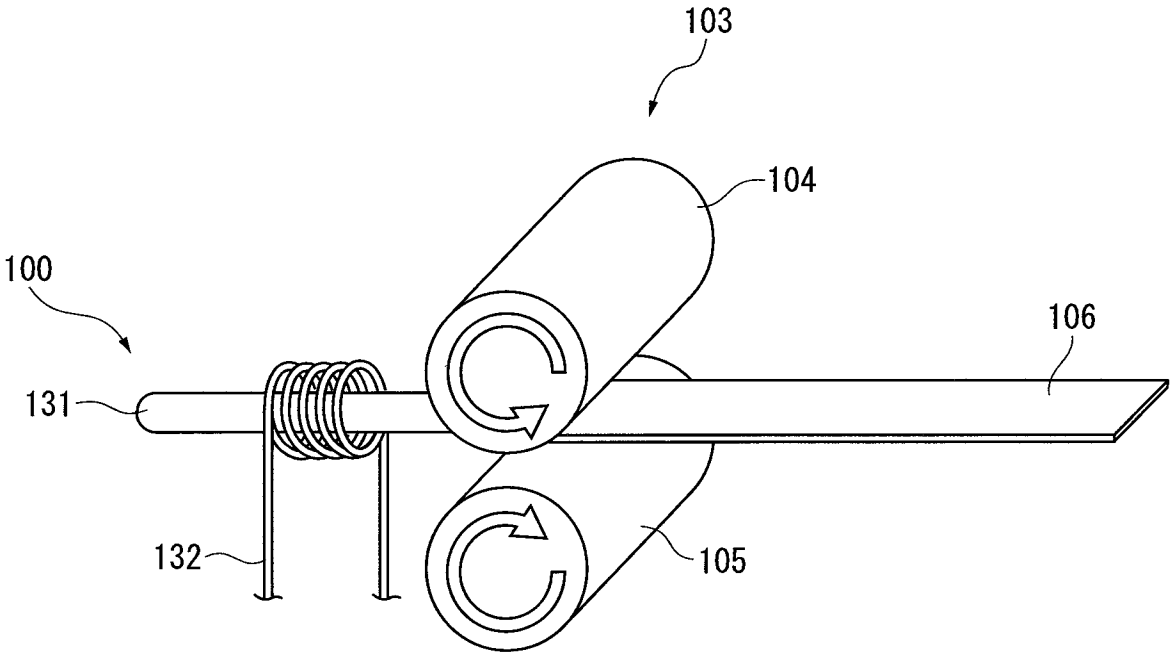
FIG. 11 is a schematic diagram illustrating a heating and rolling process for a method of production in which the wire of material is used as a metallic glass raw material.

FIG. 11 is a schematic diagram illustrating a heating and rolling process for a method of production in which the wire of material 131 is used as a metallic glass raw material 100. The wire of material 131, serving as the metallic glass raw material 100, is heated so as to reach a superplastic state. In FIG. 11, a heater 132 constituted of resistance heating heater is arranged as a heating means so as to be wound around the outer periphery of the wire of material 131 not yet fed to the rolling means. The arrangement of the heater 132 so as to be wound around the outer periphery of the wire of material 131 allows for the wire of material 131 to be heated evenly from the outer periphery. The configuration is in other regards similar to that of the first embodiment described above, and thus a description thereof has been omitted.

(Rolling Process for the (Wire of Material of) the Metallic Glass Raw Material)

Having been heated to a superplastic state by the heater 132, which is the heating means, the wire of material 131 is rolled to produce the sheet material 106. The rolling is carried out by passing the wire of material 131 in the superplastic state between the rotating pair of rollers 104, 105. The configuration is in other regards similar to that of the first embodiment described above, and thus a description thereof has been omitted.

(Actions and Effects of the Second Embodiment)

According to the present embodiment, effects similar to those of the first embodiment described above can be obtained. The use of the wire of material 131 as the metallic glass raw material 100 makes it possible to control the cross-sectional area with high accuracy, because the cross-section of the wire of material 131 is circular. Then, because of the use of the wire of material 131 for which the cross-sectional area is controlled with high accuracy, it is easy to accurately produce a sheet material 106 having the desired width dimension when the wire of material 131 is rolled into the sheet material 106 by the pair of rollers 104, 105. The wire of material can also be easily produced by spinning in a rotating liquid.

Third Embodiment

Figure 12:
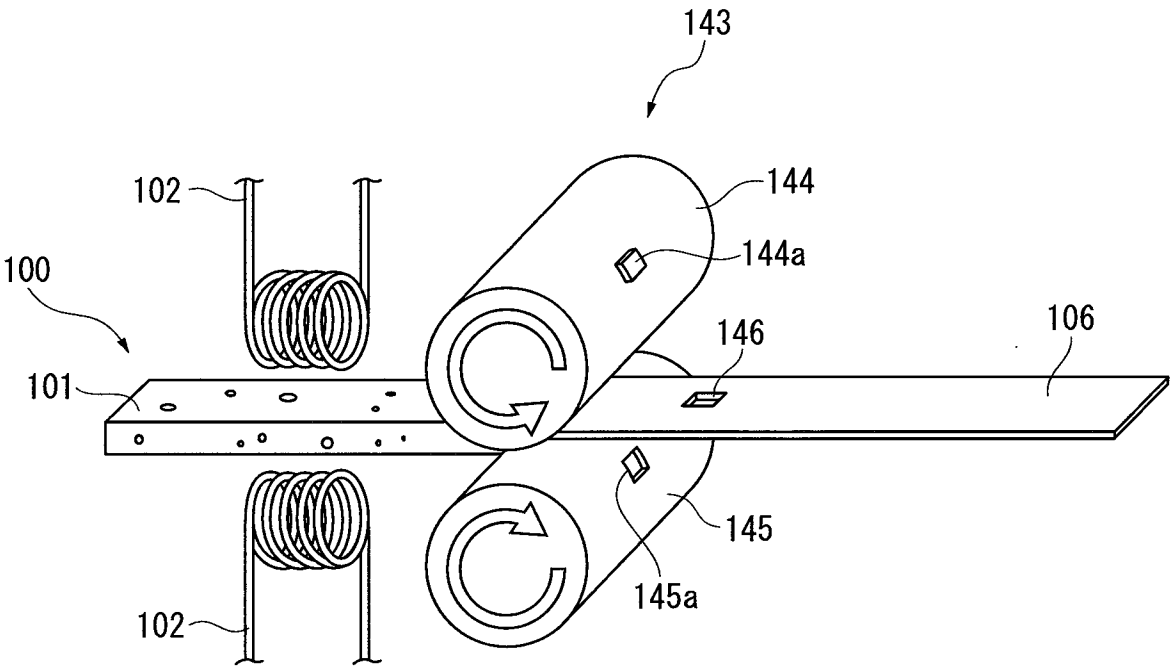
FIG. 12 is a schematic diagram illustrating a rolling process for a method of production in which a concavity and a convexity are provided to a pair of rollers in a third embodiment.

FIG. 12 is a schematic diagram illustrating a rolling process for a method of production in which a concavity 144*a* and a convexity 145*a* are provided to a pair of rollers 144, 145 in the third embodiment. The first embodiment above was described using the pair of rollers 104, 105, which have a smooth outer peripheral surface, but in the present embodiment the metallic glass raw material in a superplastic state is sandwiched between a concavity and a convexity during rolling. As illustrated in FIG. 12, a convexity 144*a* is provided to a predetermined position on the outer peripheral surface of one roller 144 of a pair of rollers 144, 145, which are a rolling means 143 used in the rolling process. A concavity 145*a*, which fits with the convexity 144*a*, is provided to a position, facing the convexity 144*a*, on the outer peripheral surface of the other roller 145. When, during rolling, the metallic glass raw material 100 in a superplastic state is passed between the rotating pair of rollers 144, 145, the metallic glass raw material 100 in a superplastic state is rolled. Together with rolling, the metallic glass raw material 100 in a superplastic state is sandwiched between the convexity 144*a* and the convexity 145*a*. FIG. 12 illustrates an example where the sandwiching between the convexity 144*a* and the concavity 145*a* forms a hole 146 in the sheet material 106.

It would be possible, for example, to form a barrel arbor hook hole, or a hole for attaching a slipping attachment, or to cut the sheet material to the length of the timepiece spring. More specifically, the convexity 144*a* of the one roller 144 would be made into a projection of a shape that suits a barrel arbor hook hole or a hole for attaching a slipping attachment, and the concavity 145*a* of the other roller 145 would be made into a hole of a shape that fits with the projection. The sandwiching of the metallic glass raw material 100 in a superplastic state during rolling between the projection and the hole thereby forms the barrel arbor hook hole or the hole for attaching a slipping attachment, at a desired position of the processed sheet material, every time the pair of rollers 144, 145 makes a revolution. Though the convexity 144*a* of the one roller 144 illustrated in FIG. 12 was taken to be the projection of the shaped described above, a ridge of a length that crosses at least the width of the sheet material can be formed, either instead of the projection of the shape described above or separately from the projection of the shape described above. Also, though the concavity 145*a* of the other roller 145 was taken to be the hole of the shape described above, a groove of a length that fits with the ridge described above can be formed, either instead of the hole of the shape described above or separately from the hole of the shape described above. The sandwiching of the metallic glass raw material 100 in a superplastic state during rolling between the ridge and the groove thereby cuts the processed sheet material 106 at a desired length every time the pair of rollers 144, 145 makes a revolution. Because of the outer peripheral length of the rollers 144, 145 corresponds to the length of the sheet material 106 being sandwiched, rollers having such an outer peripheral length as to correspond to the desired length of the sheet material are used in sandwiching the sheet material 106.

(Actions and Effects of the Third Embodiment)

According to the present embodiment, the following effects are obtained, in addition to effects similar to (1) to (6) noted above in the first embodiment.

(7) A shape corresponding to the sandwiching convexity 144*a* and concavity 145*a* can be easily processed into the sheet material 106 obtained by rolling, because the metallic glass raw material 100 in a superplastic state, upon being passed through the pair of rollers 144, 145, is sandwiched between the convexity 144*a* provided to the one roller 144 and the concavity 145*a* provided to the other roller 145.

Fourth Embodiment

Figure 13:
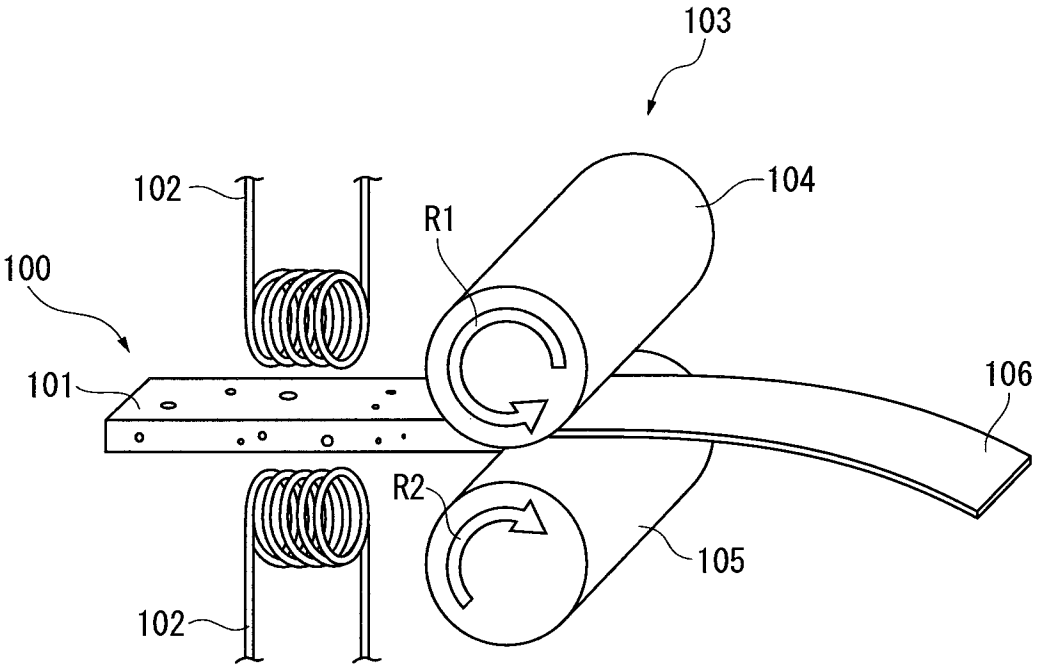
FIG. 13 is a schematic diagram illustrating a heating and rolling process for a method of production in which the relative rotational speed of a pair of rollers is controlled in a fourth embodiment.

FIG. 13 is a schematic diagram illustrating a heating and rolling process for a method of production in which the relative rotational speed of the pair of rollers is controlled in the fourth embodiment. In the first embodiment above, the rotation of the pair of rollers 104, 105 during rolling was described as being of the same rotational speed, but in the present embodiment, the relative rotational speed of the pair of rollers 104, 105 is controlled. For example, as illustrated in FIG. 13, a rotational speed R1 of the one roller 104 is made to be greater than a rotational speed R2 of the other roller 105. Having the rotational speed R1 of the one roller 104 and the rotational speed R2 of the other roller 105 be mutually different speeds during rolling in a superplastic causes the sheet material 106 being processed to be bent. The sheet material 106 is thereby deformed simultaneously with the processing of the sheet material 106 by rolling. Depending on the thickness of the resulting sheet material or the extent of deforming, the rotational speeds R1, R2 of the pair of rollers 104, 105 are adjusted as appropriate. Increasing the difference between the respective rotational speeds R1, R2 also increases the bending formed.

(Actions and Effects of the Fourth Embodiment)

According to the present embodiment, the following effects are obtained, in addition to effects similar to (1) to (6) noted above in the first embodiment.\

(8) Controlling the relative rotational speed of the pair of rollers 104, 105 during rolling makes it possible to deform the resulting sheet material 106 to a bent state. This either obviates the need to provide a separate, later step for deforming, or reduces the work for reforming in a later step, and thus makes it possible to reduce production costs.

Fifth Embodiment

Figure 14:
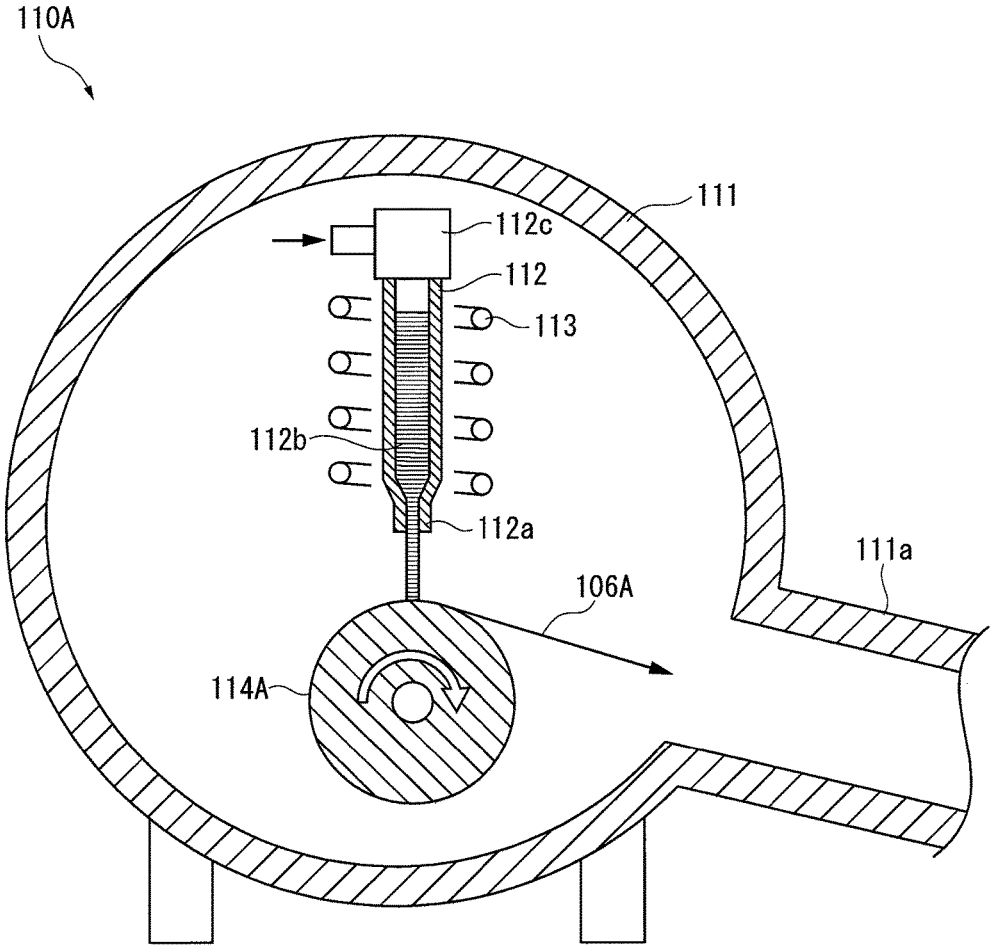
FIG. 14 is a schematic diagram illustrating a configuration of a single-roll liquid quenching device used in the production of a metallic glass sheet material in a fifth embodiment.

FIG. 14 is a schematic diagram illustrating a configuration of a single-roll liquid quenching device used in the production of a metallic glass sheet material in the fifth embodiment. In the present embodiment, the metallic glass sheet material is produced by a method using a so-called single-roll liquid quenching process (single-roll quenching), in which the sheet material of metallic glass is formed by ejecting a molten metallic glass stock material toward the outer peripheral surface of a rotating cooling roll and rapidly solidifying the ejected molten metallic glass stock material on the outer peripheral surface of the cooling roll. A single-roll liquid quenching device 110*a* used to produce the metallic glass sheet material, illustrated in FIG. 14, is of the same configuration as that of the single-roll liquid quenching device 110 illustrated in FIG. 7 as regards the configuration other than the cooling roll, and thus a description thereof has been omitted.

(Configuration of the Cooling Roll)

Figure 15:
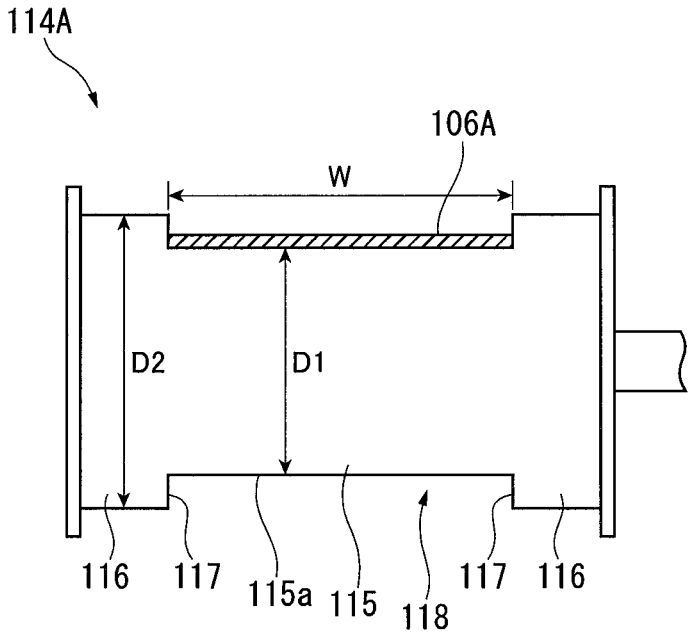
FIG. 15 is a schematic diagram illustrating a cooling roll provided with a groove section.
Figure 16:
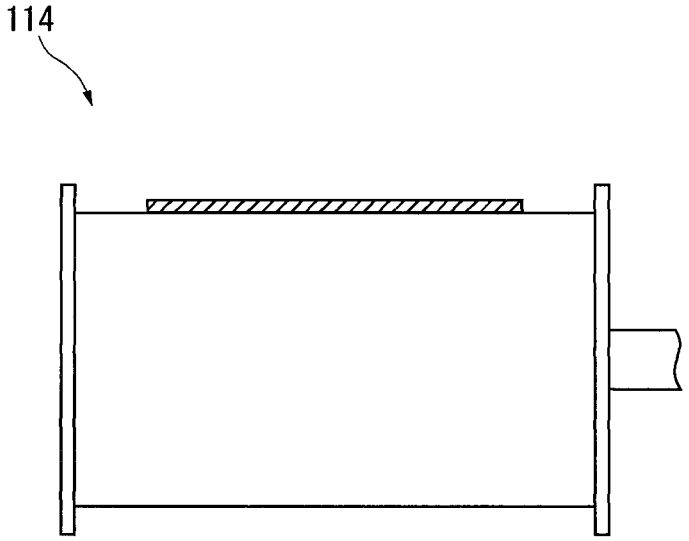
FIG. 16 is a schematic diagram illustrating a cooling roll which has a smooth outer peripheral surface.

FIG. 15 is a schematic diagram illustrating a cooling roll 114A provided with a groove section 118. FIG. 16 is a schematic diagram illustrating the cooling roll 114 which has a smooth outer peripheral surface. The cooling roll 114, which is used in the first embodiment described above, has an outer peripheral surface that is formed to be smooth, as illustrated in FIG. 16. In the present embodiment, on the other hand, the cooling roll 114A has a cooling section 115 for rapidly solidifying the molten metallic glass stock material 112*b*, as illustrated in FIG. 15. The width dimension W of the cooling section 115 is set to be the width dimension of the sheet material. The width dimension W of the cooling section 115 is the width dimension in the direction running along the axis of rotation of the cooling roll 114A.

In the present embodiment, guide sections 116, 116 are provided to both sides of the cooling section 115. The guide sections 116, 116 are formed coaxially with the cooling section 115. An outer diameter D1 of the cooling section 115 is formed to be smaller than an outer diameter D2 of the guide sections 116, 116. Side surfaces of the guide sections 116, 116 on the cooling section 115 side thereby constitute wall surfaces 117, 117, and the outer peripheral surface 115*a* of the cooling section 115 and the wall surfaces 117, 117 together create a space that forms a groove section 118. As such, the width dimension W of the groove section 118 is set so as to correspond to the width dimension of a sheet material 106A of the metallic glass being formed. Preferably, the height of the wall surfaces 117, 117, which serves as the depth of the groove section 118, is greater than the thickness of the sheet material 106A of the metallic glass being formed. The cooling roll 114A has a cooling means (not shown), and this makes it possible to maintain the cooling roll in a desired temperature range. The cooling roll 114A rotates in the direction of the arrow in FIG. 14. A speed of 4,000 rpm or higher is preferable as the rotational speed thereof. The constituent material of the cooling roll 114A is preferably a material having excellent thermal resistance and thermal conductivity, examples of which include copper, silver, gold, platinum, aluminum, and the like.

(Method for Producing the Sheet Material of Metallic Glass by the Single-Roll Liquid Quenching Process)

A method for producing the sheet material 106A of metallic glass using the single-roll liquid quenching device 110A illustrated in FIG. 14 shall now be described. Firstly, a constituent element material for obtaining the metallic glass of the invention is weighed according to the content of each of the aforementioned constituent elements, to then serve as the metallic glass stock material 112*b*. The metallic glass stock material 112*b* is housed in the quartz tube 112. The inside of the chamber 111 is then depressurized by the depressurizing means. Next, the high-frequency heating coils 113 are energized to heat the metallic glass stock material 112*b* inside the quartz tube 112 to a predetermined temperature. The metallic glass stock material 112*b* is thereby melted. Next, the molten metallic glass stock material 112*b* is ejected to the outer peripheral surface of the cooling roll 114A from the nozzle 112*a* of the quartz tube 112, due to the gas pressure being supplied into the quartz tube 112 by the gas supplying means.

Having been ejected from the nozzle 112*a* of the quartz tube 112, the molten metallic glass stock material 112*b* comes into contact with the outer peripheral surface of the cooling roll 114A and is rapidly cooled by exchanging heat with the outer peripheral surface of the cooling roll 114A. Each of the atoms present in a random fashion within the melt thereby reaches solidification in a state where the random arrangement thereof is upheld. The solidified metallic glass is discharged continuously in a tangential direction due to the centrifugal force of the rotating cooling roll 114A. A ribbon of the sheet material 106A of the metallic glass is thereby obtained. The ribbon of the sheet material 106A of metallic glass being discharged continuously from the cooling roll 114A passes through the interior of the flight tube 111*a* of the side surface of the chamber 111 and is air-cooled by flying at high speed. Preferably, the sheet material 106A of metallic glass is taken up using a take-up roll (not shown) or the like.

Controlling the amount of molten metallic glass stock material 112*b* that is ejected, controlling the viscosity of the molten metallic glass stock material 112*b*, and the like also makes it possible to control the sheet material to a desired thickness. The amount of molten metallic glass stock material 112*b* that is ejected is controlled by adjusting the gas flow rate being supplied by the gas supplying means 112*c* and altering the gas pressure in the quartz tube 112. The viscosity of the molten metallic glass stock material 112*b* is controlled by adjusting the voltage of the high-frequency heating coils 113 and altering the heating temperature, thereby altering the temperature of the molten metallic glass stock material 112*b* in the quartz tube 112.

The sheet material 106A of the metallic glass obtained by this method of production is then processed to the length needed for use as a power source for the drive mechanism 1A. In the case of a sheet material 106A of the metallic glass which includes a single sheet of a thickness t (0.1 mm) necessary for the metallic glass main spring 31, deforming is carried out by winding the metallic glass main spring 31 around a round bar or the like. In the case where the metallic glass main spring 31 is deformed, it is sufficient to carry out the deforming by carrying out a heat treatment with a temperature of 150° or higher. In the case of a plurality of layers that are layered and integrated, as is illustrated in FIG. 5, then each of the metallic glass sheet materials 313 is bonded together using the epoxy-based adhesive 314 to ensure the thickness t (0.1 mm) necessary for the metallic glass main spring 31. Finally, before the epoxy-based adhesive 314 is cured, deforming is carried out by winding the metallic glass main spring 31 about a round bar or the like, and then the epoxy-based resin 314 is cured.

(Actions and Effects of the Fifth Embodiment)

(9) In a case where the cooling roll 114 having a smooth outer peripheral surface, illustrated in FIG. 16, is used, then in some instances a sheet material of a greater width dimension than the desired dimension is formed. According to the present embodiment, on the other hand, the outer peripheral surface 115*a* of the cooling section 115 and the wall surfaces 117, 117, which are the side surface of the guide sections 116, 116 on the cooling section 115 side, together create a space that forms the groove section 118, and therefore even when the ejected molten metallic glass stock material 112*b* widens in the width direction on the outer peripheral surface of the cooling roll 114A, the widening thereof is regulated by the wall surfaces 117, 117 of the groove section 118, and thus the width dimension of the sheet material 106A of the metallic glass being formed will not widen beyond the width dimension W of the groove section 118. As such, the use of the cooling roll 114A provided with the groove section 118 described above makes it possible to produce the sheet material 106A of metallic glass of the desired width dimension, easily and with high accuracy. The molten metallic glass stock material 112*b* comes into contact with the cooling surfaces 117, 117 constituting the groove section 118 and is cooled, and thus it is possible to produce a sheet material 106A of metallic glass that has smooth, neat side surfaces. Also, because the sheet material 106A of metallic glass is produced at the desired width dimension with high accuracy, it is possible to obviate the need for a later step for machining or the like implemented in order to have the sheet material 106A of metallic glass be of the desired width dimension; alternatively, it is possible to reduce the later step.

(10) Because the metallic glass main spring 31 is employed as the power source for the drive mechanism 1A, the drive mechanism 1A can be reduced in scale and also the drive mechanism 1A can be operated for a long time.

(11) The position of the inflection point 315 can be set to be in the vicinity of the inner end 311, and thus the deforming can be carried out spanning substantially the full length of the metallic glass main spring 31, and the mechanical energy stored by the metallic glass main spring 31 can be increased and the operation of the drive mechanism 1A can be sustained for even longer. There is little fluctuation in the torque with the metallic glass main spring 31, and thus the drive precision is enhanced in a case where the metallic glass main spring 31 is employed as the power source of a mechanical timepiece.

In the present embodiment, the metallic glass main spring 31 was used as the power source of the drive mechanism 1A of the electronically controlled mechanical timepiece 1, but there is no limitation thereto, and the metallic glass main spring 31 can be used in the driving mechanism of an ordinary mechanical timepiece in which the control system is constituted of a speed governor and an escapement.

Sixth Embodiment

Figure 17:
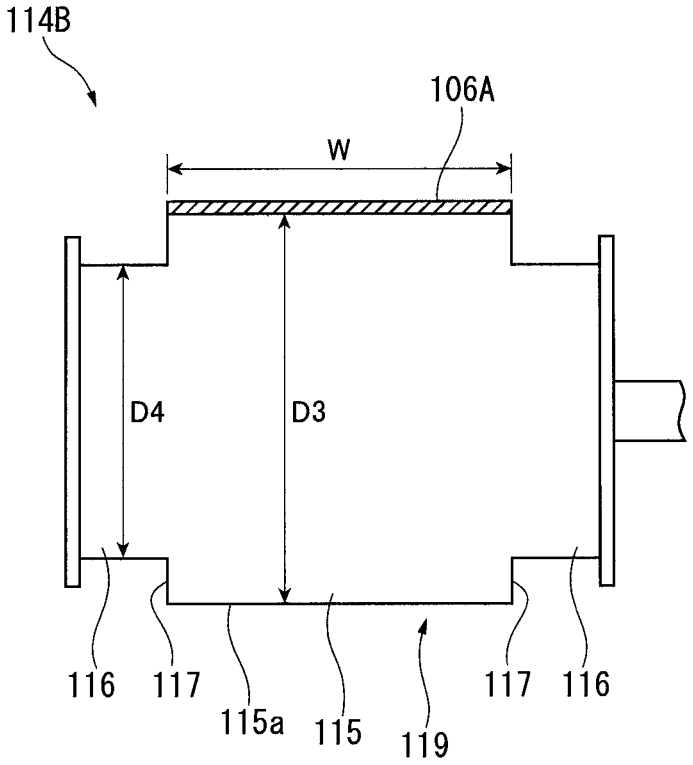
FIG. 17 is a schematic diagram illustrating a cooling roll provided with a protruding section.

FIG. 17 is a schematic diagram illustrating a cooling roll 114B provided with a protruding section 119. In the fifth embodiment described above, the cooling roll 114A provided with the groove section 118 was used, but in the present embodiment, the cooling roll 114B provided with the protruding section 119 as illustrated in FIG. 17 is used. An outer diameter D3 of the cooling section 115 is formed so as to be greater than an outer diameter D4 of the guide section 116, 116. The side surfaces of the cooling section 115 thereby constitute the wall surfaces 117, 117, and the outer peripheral surface 115*a* of the cooling section 115 and the wall surfaces 117, 117 that are each orthogonal to the outer peripheral surface 115*a* together create a space that forms the protruding section 119. As such, the width dimension W of the protruding section 119 is set so as to correspond to the width dimension of a sheet material 106A of the metallic glass being formed. The configuration is in other regards similar to that of the fifth embodiment described above, and thus a description thereof has been omitted.

(Actions and Effects of the Sixth Embodiment)

According to the present embodiment, the outer peripheral surface 115*a* of the cooling section 115 and the wall surfaces 117, 117, which are the side surfaces of the cooling section 115, together create a space that forms the protruding section 119, and therefore even when the ejected molten metallic glass stock material 112*b* widens in the width direction on the outer peripheral surface of the cooling roll 114B, any portion that overflows beyond the protruding section 119 flows down toward the guide section 116, 116 side, and thus the width dimension of the sheet material 106A of the metallic glass being formed will not widen beyond the width dimension W of the protruding section 119. As such, the use of the cooling roll 114B provided with the protruding section 119 described above makes it possible to produce the sheet material 106A of metallic glass of the desired width dimension, easily and with high accuracy. Because of the adoption of a configuration where the cooling section 115 projects out beyond the guide sections 116, 116 on both sides, it is easy to carry out maintenance for removing any residual metallic glass stock material that has adhered to the outer peripheral surface 115*a* of the cooling section 115 in the steps for producing the sheet material 106A of metallic glass.

Seventh Embodiment

Figure 18:
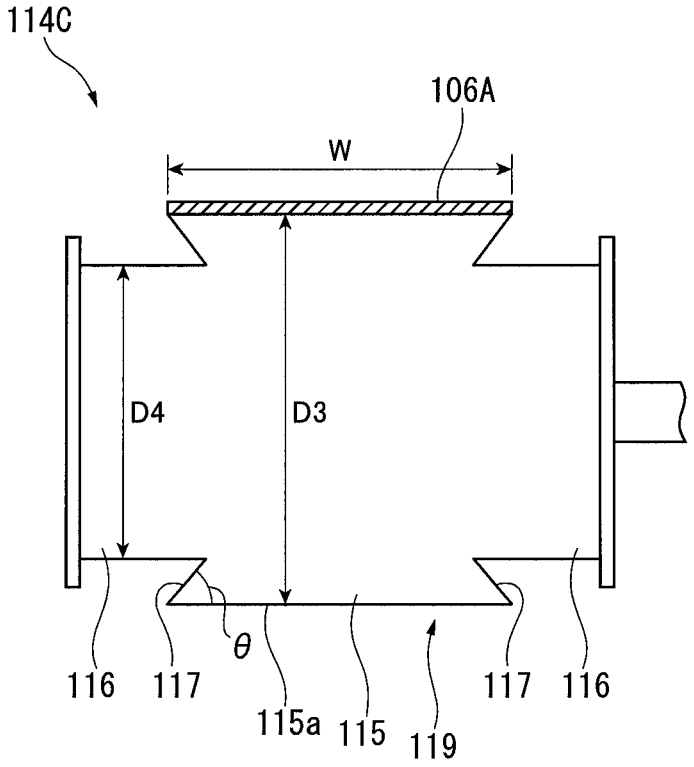
FIG. 18 is a schematic diagram illustrating a cooling roll provided with a protruding section in another aspect.

FIG. 18 is a schematic diagram illustrating a cooling roll 114C provided with the protruding section 119 in another aspect. In the sixth embodiment described above, the cooling roll 114B provided with the protruding section 119 was used, but in the present embodiment, the cooling roll 114C provided with the protruding section 119, in which an angle θ at which the outer peripheral surface 115*a* of the cooling section 115 and the wall surfaces 117 intersect is set to be an acute angle as illustrated in FIG. 18, is used. The cooling section is configured so that the width dimension becomes smaller going toward the center of the axis of rotation of the cooling roll 114C. That is to say, the angle θ at which the outer peripheral surface 115*a* of the cooling section 115 and the wall surfaces 117 intersect is set so as to be an acute angle. The width dimension W of the protruding section 119 is set so as to correspond to the width dimension of the sheet material 106A of the metallic glass being formed. The configuration is in other regards similar to that of the sixth embodiment described above, and thus a description thereof has been omitted.

(Actions and Effects of the Sixth Embodiment)

According to the present embodiment, the following effects are obtained, in addition to the effects noted above in the sixth embodiment. The cooling section 115 is configured so that the width dimension W becomes smaller going toward the center of the axis of rotation of the cooling roll 114C, and therefore there will be better hot water exhaustion when the molten metallic glass stock material 112*b* flows down on the guide section 116, 116 sides of the cooling roll 114*c*, and also it is possible to prevent dripping for the portion of the ejected molten metallic glass stock material 112*b* that overflows beyond the outer peripheral surface 115*a* of the cooling section 115 constituting the protruding section 119. Thus, the accuracy of the width dimension of the sheet material 106A of the metallic glass can be even further enhanced.

Eighth Embodiment

Figure 19:
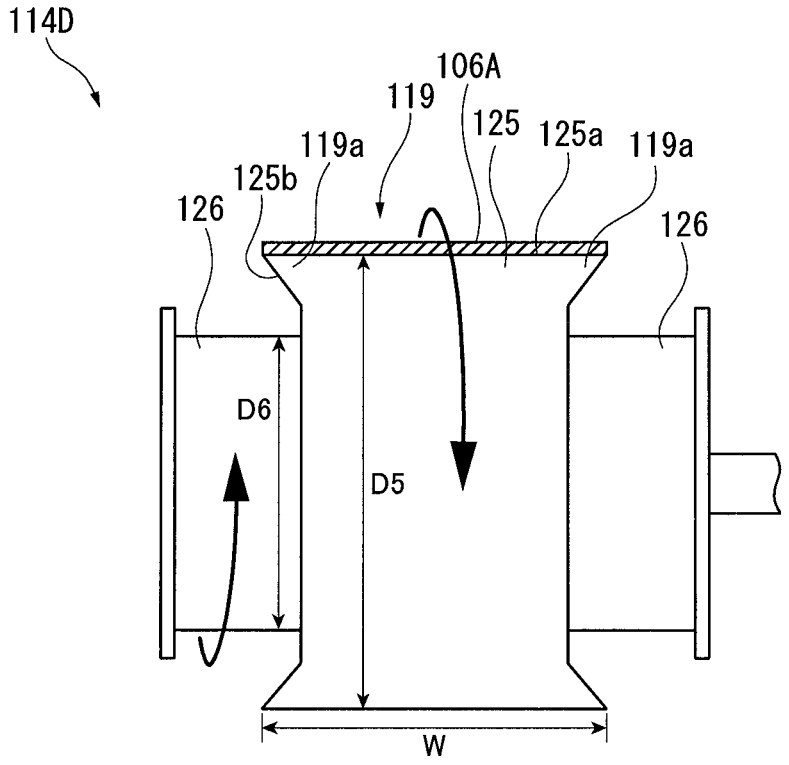
FIG. 19 is a schematic diagram illustrating a cooling roll constituted of a first roll and second rolls.

FIG. 19 is a schematic diagram illustrating a cooling roll 114D constituted of a first roll 125 and second rolls 126. In the present embodiment, as illustrated in FIG. 19, the cooling roll 114D is provided with a first roll 125 constituting the cooling section 115 and two second rolls 126, 126 which are adjacent to both sides of the first roll 125 and constitute the guide section 116, 116. An outer diameter D5 of the first roll 125 is configured so as to be greater than an outer diameter D6 of the second rolls 126. The protruding section 119 is thereby formed of an outer peripheral surface 125*a* and two side surfaces 125*b* of the first roll 125. Also, the first roll 125 is configured so that the width dimension W becomes smaller going toward the center of the axis of rotation of the first roll 125. That is to say, the angle θ at which the outer peripheral surface 125*a* of the first roll 125 and the side surfaces 125*b* of the first roll 125 intersect is set so as to be an acute angle. The width dimension W of the protruding section 119 is set so as to correspond to the desired width dimension of the sheet material 106A of the metallic glass being formed. The first roll 125 and the two second rolls 126, 126 respectively rotate in opposite directions. The configuration is in other regards similar to that of the sixth embodiment described above, and thus a description thereof has been omitted.

(Actions and Effects of the Eighth Embodiment)

According to the present embodiment, the following effects are obtained, in addition to the effects noted above in the sixth and seventh embodiments. The molten metallic glass stock material 112*b* ejected from the nozzle 112*a* of the quartz tube 112 widens in the width direction on the outer peripheral surface of the cooling roll 114D, and the portion overflowing beyond the first roll 125 flows downward toward the second rolls 126, 126. Because the second rolls 126, 126 rotate in a direction opposite to that of the first roll 125, the molten metallic glass stock material 112*b* having flowed down toward the second rolls 126, 126 is discharged by the centrifugal force of the second rolls 126, 126 in a direction on the side opposite to the direction of the sheet material 106A of metallic glass being formed on the outer peripheral surface 125*a* of the first roll 125. For this reason, it is easy to recover the stock material that has flowed down.

Other Embodiments

The invention is not to be limited to the above-described embodiments, but rather any modification, improvement, or the like made within a scope capable of achieving the objectives of the invention is intended to be encompassed by the invention. In the first through fourth embodiments, a cooling means can be provided to the pair of rollers that are the rolling means 103, 143. This makes it possible to cool the ribbon of sheet material of metallic glass that has been processed, simultaneously with the rolling, and thus it is easier to prevent deformation of the processed sheet of material as well as adhesion between the sheets of material during take-up. A heating means can also be provided to the pair of rollers that are the rolling means 103, 143. In the fifth embodiment, the wall surfaces can be constituted of cooling section sides of a covering layer, by providing the covering layer to both end sides of the cooling roll having a smooth outer peripheral surface so as to cover the outer periphery thereof, and the groove section 118 can be constituted of the outer peripheral surface of the cooling section and the wall surfaces. Similarly, in the sixth and seventh embodiments, the wall surfaces 117, 117 can be constituted of side surfaces of a covering layer, by providing the covering layer to the middle of the cooling roll having a smooth outer peripheral surface so as to cover the outer periphery thereof, and the protruding section 119 can be constituted of the outer peripheral surface of the cooling section and the wall surfaces. In the eighth embodiment, the first roll 125 can adopt a configuration where the protruding section 119 is formed by a space created by the outer peripheral surface and the wall surfaces each orthogonal to the outer peripheral surface.

First Modification Example

Figure 20:
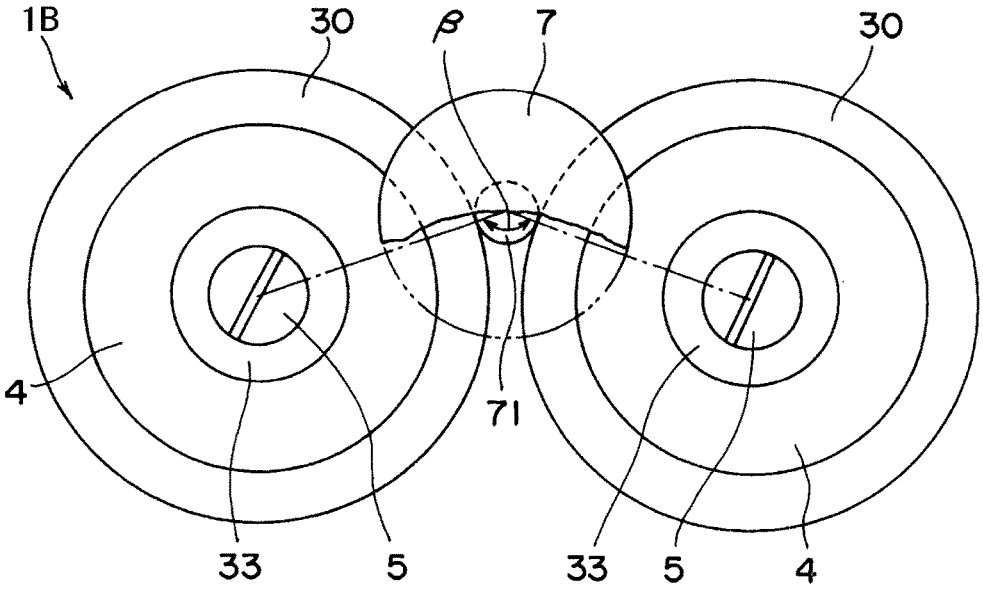
FIG. 20 is a partial plan view illustrating a drive mechanism provided with two barrels.
Figure 21:
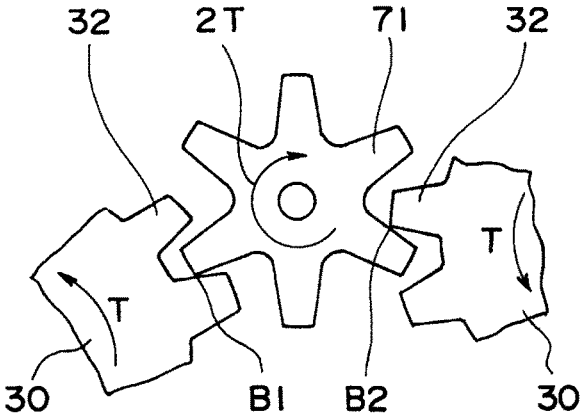
FIG. 21 is a partial plan view illustrating a state of meshed engagement between barrels and a train wheel.

FIG. 20 is a partial plan view illustrating a drive mechanism 1B provided with two barrels 30. FIG. 21 is a partial plan view illustrating a state of meshed engagement between the barrels 30 and a train wheel. In the drive mechanism 1A as in the first embodiment described above, the power source for actuating the drive mechanism 1A was solely one metallic glass main spring 31 housed in the barrel 30, but the power source can be a drive mechanism 1B provided with two barrels 30 in which the metallic glass main spring 31 is housed, as illustrated in FIGS. 20 and 21. The barrel gear wheels 32 (not shown in FIG. 20) formed on the outer periphery of the two barrels 30 have meshed engagement at the same time with a base section gear wheel 71 of the second wheel 7 in the drive mechanism 1B, as illustrated in FIG. 20. The two barrels 30 turn in the same direction, centered on each of the barrel arbors 33, and an output torque 2T obtained when the output torques T of each of the metallic glass main springs 31 are added together acts on the second wheel 7.

Herein, the barrel gear wheels 32 for meshed engagement with the second wheel 7 differ in the phases of meshed engagement by the left-side barrel gear wheel 32 and by the right-side barrel gear wheel 32, as illustrated in FIG. 21; when the left-side barrel gear wheel 32 abuts against the second wheel 7 at a point B1, the right-side barrel gear wheel 32 will be separating from the second gear wheel 7 at a point B2. The difference in phase of such description is determined by the relative position of the barrel arbors 33; as will be readily understood from FIG. 20, the phase of meshed engagement can be adjusted in accordance with an angle β formed by center of rotation of the second wheel 7 and the barrel arbors 33.

According to the drive mechanism 1B of such description, provided with the two barrels 30 in which the metallic glass main spring 31 is housed, the following effects are obtained in addition to the effects of the drive mechanism 1A provided with one barrel 30. That is to say, the two barrels 30 in which the metallic glass main spring 31 is housed have meshed engagement at the same time with the second wheel 7 constituting the train wheel at the same time, and therefore it is possible to superpose the output torques T of each of the barrels 30 to rotate the second wheel 7, and possible to actuate the drive mechanism 1B with the higher output torque 2T. Also, the phases of the barrel gear wheels 32 having meshed engagement with the second wheel 7 are shifted apart from each other, and therefore in, for example, FIG. 21, fluctuation in the transmitted torque can be minimized and the drive mechanism 1B can be smoothly actuated by adding a fluctuation in the torque occurring because of the state of meshed engagement between the left-side barrel 30 and the second wheel 7 and the torque occurring because of the state of meshed engagement with the other, right-side barrel 30.

In the first modification example of such description, two barrels 30 were in meshed engagement with the second wheel 7 constituting the train wheel, but two or more barrels 30 can also be in meshed engagement. In brief, it suffices to make a determination as appropriate in accordance with the stored energy of the metallic glass main springs and the energy required as a power source for the drive mechanism.

Second Modification Example

Figure 22:
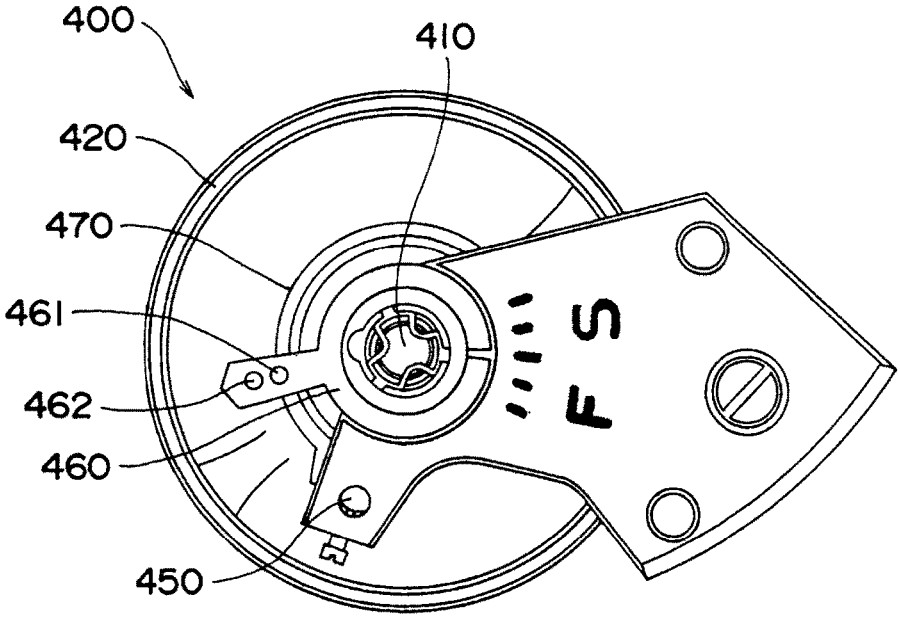
FIG. 22 is a plan view illustrating a structure with a spring balance system provided with a balance spring.

FIG. 22 is a plan view illustrating a structure with a spring balance system 400 provided with a balance spring 470.

Figure 23:
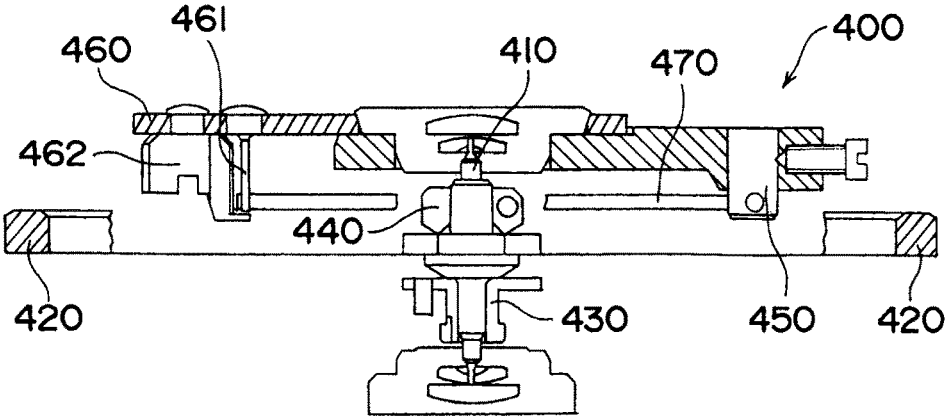
FIG. 23 is a cross-sectional view illustrating the structure of the spring balance system 400 in FIG. 22.

FIG. 23 is a cross-sectional view illustrating the structure of the spring balance system 400 in FIG. 22. The timepiece spring constituted of a metallic glass as in the invention can be a balance spring for urging the balance constituting the speed governor of the mechanical timepiece, as illustrated in FIGS. 22 and 23. The spring balance system 400 constituting the speed governor is configured to include a balance staff 410, a balance wheel 420, a roller 430, a collet 440, a hairspring stud 450, and a regulator 460.

The balance wheel 420, the roller 430, and the collet 440 are fixed to the balance staff 410, illustrated in FIGS. 22 and 23, and are configured so as to rotate integrally with each other. The balance spring 470 is a non-magnetic body constituted of metallic glass, an inner peripheral end of which is fixed to the collet 440 and an outer peripheral end of which is fixed to the hairspring stud 450. The regulator 460 is configured to include a curb pin 461 and a balance spring buckle 462, and an outermost peripheral portion of the balance spring 470 passes between the curb pin 461 and the balance spring buckle 462.

In the spring balance system 400 of such description, when the balance wheel 420 rotates about the balance staff 410, the collet 440 also rotates in association therewith, and therefore the urging force of the balance spring 470 acts on the balance wheel 420; when this urging force and the inertial force of the balance wheel 420 are in equilibrium, the rotation of the balance wheel 420 stops, and the urging force of the balance spring 470 causes the balance wheel 420 to rotate in the reverse direction. That is to say, the balance wheel 420 repeatedly oscillates about the balance staff 410. The oscillating period of the balance wheel 420 can be altered by finely adjusting the positions of the curb pin 461 and balance spring buckle 462 of the regulator 460. The oscillating period S changes also depending on the moment of inertia J of the rotating portions, such as the balance wheel 420, as well as the material properties of the balance spring 470, and is represented by the following formula (I), where "b" is the width of the balance spring 470, "t" is the thickness, "L" is the main spring length, and "E" is the mean Young's modulus of the balance spring.

$$S=2\pi\times(12JL/Ebt^3)^{1/2} \quad (1)$$

In the spring balance system 400 of such description, the balance spring 470 is constituted of the metallic glass, and therefore there is little change in the mean Young's modulus E in association with changes in temperature, as well as little change in the oscillating period of the spring balance system 400 represented by the formula (1), thus making it possible to achieve a more accurate mechanical timepiece having a speed governor that includes the spring balance system 400. Also, because the balance spring 470 is constituted of a metallic glass non-magnetic material, the magnetic resistance is improved, and the properties of the main spring will not diminish even when the balance spring 470 is pulled by an external magnetic field or the like.

Third Modification Example

Figure 24:
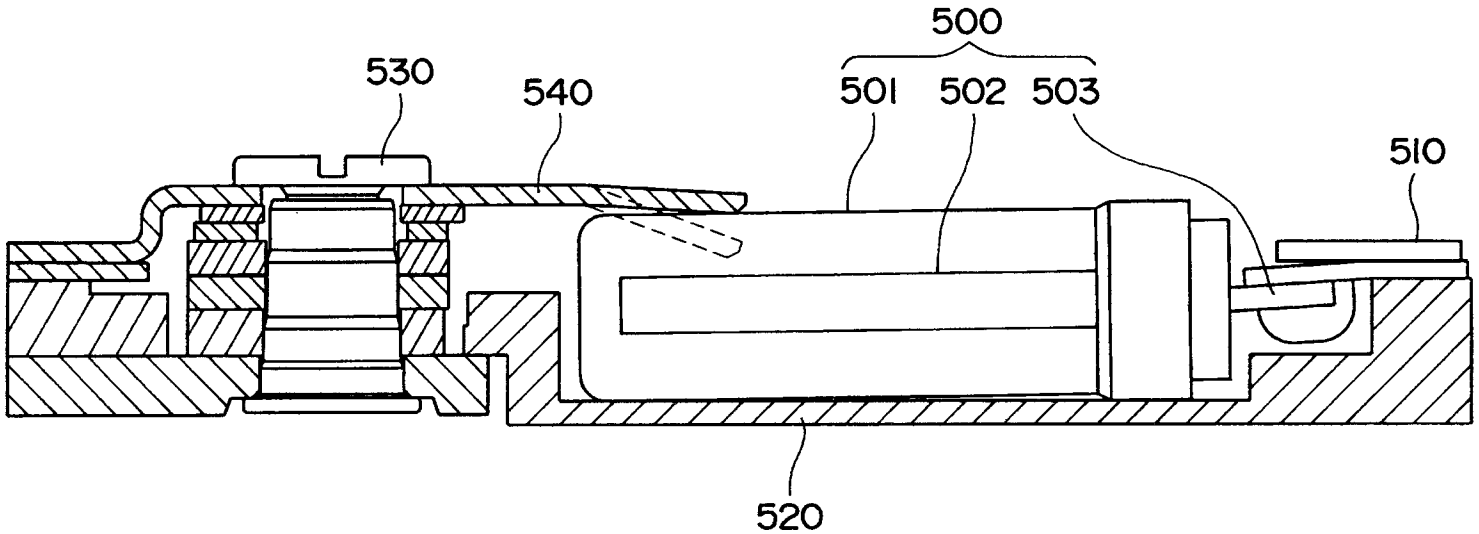
FIG. 24 is a side view illustrating a fixing structure for a crystal oscillator provided with a fixing spring.

FIG. 24 is a side view illustrating a fixing structure for a crystal oscillator 500 provided with a fixing spring 540. A spring constituted of the metallic glass as in the invention can be utilized as a spring for fixing a crystal oscillator 500 of a crystal oscillation timepiece in an urged state. The crystal oscillator 500 is configured to include a vacuum capsule 501 and a main oscillator body 502, of a tuning fork type, housed in the interior of the vacuum capsule 501; a terminal 503 provided to an end section of the vacuum capsule 501 is electrically connected to a circuit board 510, thus constituting an oscillation circuit. The crystal oscillator 500 is arranged on a ground plane 520, and is fixed in a state of being urged in the direction of being pinned down to the ground plane 520 by a screw 530 and the fixing spring 540 constituted of the metallic glass.

In the crystal oscillator 500 of such description, the fixing spring 540 constituted of the metallic glass has a small mean Young's modulus, and therefore there is little fluctuation in the urging force thereof even when the amount of deflection of the 540 changes; therefore, it is possible to reduce deviation in the period of the crystal oscillator, and achieve a more accurate crystal oscillator timepiece.

A click spring constituting the click 6, which has meshed engagement with the ratchet wheel 4 of the drive mechanism 1A of the embodiments described above, can also be constituted of the metallic glass. The click 6 is a component for preventing letting down during winding of the main spring within the barrel, and the spring that functions at such a time is a click spring. While the main spring is being wound, the click spring bears a cyclic loading commensurate with the number of meshing teeth of the ratchet wheel engaged with the click; the loading takes place several tens of thousands to several hundreds of thousands of times per year. When such a cyclic loading is applied, the allowable stress of the click spring must be set to be not more than ½ the maximum stress. As such, when the spring constituted of the metallic glass is used for such a click spring, the allowable stress can be set so as to be higher, and there will also be little variance in the urging force thereof, and therefore the metallic glass can also be advantageously used as a material for a click spring.

In the embodiments described above, the single-roll liquid quenching process and the spinning in a rotating liquid were cited as methods for producing the metallic glass raw material 100; however, not only these methods of production but also a double-roll liquid quenching process, rotating disk process, or the like can be employed. Also, in the embodiments described above, the metallic glass mainspring 31 was used as the power source of the drive mechanism 1A of the timepiece, but there is no limitation thereto, and the metallic glass mainspring 31 can also be used as a power source for another drive mechanism, such as a music box. The timepiece spring of the invention itself can also be applied not only to a timepiece but also another precision instrument, such as a music box. Further, the timepiece spring and metallic glass mainspring 31 of the invention can be applied to a low-torque timepiece. Furthermore, the specific structures, shapes, and the like in embodying the invention can be otherwise structured and so forth, within a scope able to achieve another objective.

What is claimed is:

1. A method for producing a timepiece spring, comprising:

producing, by quenching, a metallic glass raw material constituted of a metallic glass;

heating the metallic glass raw material by a heater to increase temperature of the metallic glass raw material to achieve a superplastic state; and rolling the metallic glass raw material in the superplastic state to produce a sheet material, the rolling of the metallic glass raw material including passing the metallic glass raw material in the superplastic state between a pair of rotating rollers that is oppositely facing with each other and has different rotational speed from each other to simultaneously produce and deform the sheet material such that the sheet material has a curved longitudinal axis that is curved towards one of the rotating rollers.

2. The method for producing a timepiece spring as set forth in claim 1, wherein a convexity is provided to a predetermined position on an outer peripheral surface of one of the rotating rollers and a concavity that fits with the convexity is provided to a position that faces the convexity on an outer peripheral surface of the other one of the rotating rollers, and the metallic glass raw material in the superplastic state is rolled and sandwiched between the convexity and the concavity while passing between the rotating rollers.

3. The method for producing a timepiece as set forth in claim 1, wherein the metallic glass raw material is a sheet of material produced by a single-roll liquid quenching process.

4. The method for producing a timepiece as set forth in claim 1, wherein the metallic glass raw material is a wire of material produced by spinning in a rotating liquid.

5. A timepiece spring obtained by the method for producing a timepiece spring as set forth in claim 1.

6. A timepiece including the timepiece spring as set forth in claim 5.

7. A method for producing a timepiece spring, comprising:

producing, by quenching, a metallic glass raw material constituted of a metallic glass;

heating the metallic glass raw material by a heater to increase temperature of the metallic glass row material to achieve a superplastic state; and rolling the metallic glass raw material in the superplastic state to produce a sheet material, the rolling of the metallic glass raw material including passing the metallic glass raw material in the superplastic state between a pair of rotating rollers, a convexity being provided to a predetermined position on an outer peripheral surface of one of the rotating rollers and a concavity that fits with the convexity being provided to a position that faces the convexity on an outer peripheral surface of the other one of the rotating rollers, the metallic glass raw material in the superplastic state being rolled and sandwiched between the convexity and the concavity while passing between the rotating rollers, the outer peripheral surface of the one of the rotating rollers having a larger diameter at the convexity than at a portion of the outer peripheral surface of the one of the rotating rollers other than the convexity in a cross section taken along an imaginary plane that is perpendicular to a rotational axis of the one of the rotating rollers, and the outer peripheral surface of the other one of the rotating rollers having a smaller diameter at the concavity than a portion of the outer peripheral surface of the other one of the rotating rollers other than the concavity in a cross section taken along the imaginary plane.

* * * * *